US007289075B2

(12) United States Patent
Kagaya et al.

(10) Patent No.: US 7,289,075 B2
(45) Date of Patent: Oct. 30, 2007

(54) PLANAR ANTENNA

(75) Inventors: Osamu Kagaya, Kanagawa (JP); Kiyoshi Oshima, Kanagawa (JP); Koji Ikawa, Kanagawa (JP)

(73) Assignee: Asahi Glass Company, Limited, Tokyo (JP)

( * ) Notice: Subject to any disclaimer, the term of this patent is extended or adjusted under 35 U.S.C. 154(b) by 169 days.

(21) Appl. No.: 11/004,904

(22) Filed: Dec. 7, 2004

(65) Prior Publication Data

US 2005/0128161 A1 Jun. 16, 2005

(30) Foreign Application Priority Data

Dec. 10, 2003 (JP) ..... 2003-411246
Feb. 18, 2004 (JP) ..... 2004-041634

(51) Int. Cl.
*H01Q 11/12* (2006.01)

(52) U.S. Cl. ..... 343/741; 343/744

(58) Field of Classification Search ..... 343/713, 343/748, 726, 728, 741–744
See application file for complete search history.

(56) References Cited

U.S. PATENT DOCUMENTS 3,771,159 A 11/1973 Kawaguchi et al.
4,547,776 A * 10/1985 Bolt et al. ..... 343/741
5,285,210 A 2/1994 Sato et al.
5,402,134 A 3/1995 Miller et al.
6,252,550 B1 6/2001 Vernon
2002/0018020 A1 2/2002 Vernon
2004/0008144 A1 1/2004 Kubota
2005/0128161 A1 6/2005 Kagaya et al.

FOREIGN PATENT DOCUMENTS

EP 0 786 824 A1 7/1997

(Continued)

OTHER PUBLICATIONS

Kazuhide Hirose, et al., "Dual Loop Array Antenna Fed by Quasi-Balanced Pair Line", Information and Communication Engineers, Communication Society Conference, 2004, p. 68 (with partial English translation).

(Continued)

*Primary Examiner*—Michael C. Wimer
(74) *Attorney, Agent, or Firm*—Oblon, Spivak, McClelland, Maier & Neustadt, P.C.

(57) ABSTRACT

There are disposed first coupling conductors, which comprise a pair of coupling branch lines 1 and 2 connected to the first antenna conductor 3 and extend inward from the first antenna conductor. The coupling branch lines 1 and 2 have open ends 1*a* and 2*a* disposed so as to be adjacent to each other and be capacitively coupled to each other. The open ends 1*a* and 2*a* of the coupling branch lines 1 and 2 are located at closest or substantially closest portions to each other. The second antenna conductor 13 includes second coupling conductors, which comprise a pair of coupling branch lines 11 and 12 connected the second antenna conductor 13 and extending inward from the second antenna conductor. The coupling branch lines 11 and 12 have open ends disposed so as to be adjacent to each other and be capacitively coupled to each other. The open ends of the coupling branch lines 11 and 12 are located at closest or substantially closest portions to each other.

43 Claims, 22 Drawing Sheets

FOREIGN PATENT DOCUMENTS

| | | |
|---|---|---|
| EP | 0 877 439 A2 | 11/1998 |
| JP | 4-14304 | 1/1992 |
| JP | 5-275918 | 10/1993 |
| JP | 6-152216 | 5/1994 |
| JP | 7-106827 | 4/1995 |
| JP | 7-115318 | 5/1995 |
| JP | 7-154123 | 6/1995 |
| JP | 3020658 | 11/1995 |
| JP | 8-51312 | 2/1996 |
| JP | 8-78941 | 3/1996 |
| JP | 9-93019 | 4/1997 |
| JP | 9-232834 | 9/1997 |
| JP | 9-298413 | 11/1997 |
| JP | 10-308620 | 11/1998 |
| JP | 11-88034 | 3/1999 |
| JP | 11-355030 | 12/1999 |
| JP | 2000-13131 | 1/2000 |
| JP | 2002-196327 | 7/2000 |
| JP | 2001-7632 | 1/2001 |

OTHER PUBLICATIONS

Berndie Strassner, et al., Highly Efficient C-Band Circularly Polarized Rectifying Antenna Array for Wireless Microwave Power Transmission, IEEE Transactions on Antennas and Propagation., vol. 51, No. 6, Jun. 2003, pp. 1347-1356.

Berndie Strassner, et al., "5.8GHz Circularly Polarized Dual-Rhombic-Loop Traveling-Wave Rectifying Antenna for low Power-Density Wireless Power Transmission Applications", IEEE Transactions on Microwave Theory and Techniques, vol. 51, No. 5, May 2003, pp. 1548-1553.

Berndie Strassner, et al., "A Circularly Polarized Rectifying Antenna Array for Wireless Microwave Power Transmission with over 78% Efficiency", IEEE MTT-S CDROM, 2002, pp. 1535-1538.

H. Morishita, et al., "Circulary Polarised rhombic hula hoop antennas", Electronics Letter, vol. 32, No. 11, May 23, 1996 pp. 946-947.

U.S. Appl. No. 11/527,624, filed Sep. 27, 2006, Kagaya, et al.

* cited by examiner

PLANAR ANTENNA

The present invention relates to a planar antenna, and in particular, relates to a planar antenna, which is appropriate to radio wave communication using a circularly polarized wave having a frequency from about 1 to about 30 GHz, in particular from about 1 to about 6 GHz, and which is appropriate to a glass antenna for vehicles.

A GPS (Global Positioning System), an ETC (Electric Toll Collection System) or the like has been recently employed to communicate between an in-vehicle communication device and an external communication device by an electromagnetic wave in order to make vehicles run smoother.

As the antenna for in-vehicle communication used in such a system, it has been proposed to employ, e.g., a vehicle window glass antenna for UHP shown in FIG. 21 (see, e.g., JP-A-9-93019). In this prior art, a loop antenna conductor 23 is connected to two capacitive coupling conductors 24 to increase an antenna gain by capacitive coupling between parallel close portions of the capacitive coupling conductors 24, which have a length of $L_{23}$. However, this prior art is directed to an antenna for linearly polarized wave. When the antenna is employed to a circularly polarized wave having a frequency in the order of GHz, the antenna has had problems of a poor axial ratio and a low antenna gain. From this viewpoint, it has been demanded to provide a planar antenna for a circularly polarized wave, which is more excellent in terms of axial ratio and antenna gain than the conventional antenna.

It is an object of the present invention to provide a planar antenna capable of solving the problems caused in the prior art.

The present invention provides a planar antenna comprising a dielectric substrate having a first antenna conductor in a loop shape and a second antenna conductor in a loop shape disposed so as to be adjacent to each other;

characterized in that there are disposed first coupling conductors, the first coupling conductors comprising a pair of coupling branch lines connected to the first antenna conductor and extending inward from the first antenna conductor, and the coupling branch lines have open ends disposed so as to be adjacent to each other and to be capacitively coupled to each other;

that when the coupling branch lines are parallel with each other or in alignment with each other, both open ends of the coupling branch lines are closest portions with respect to each other;

that when the coupling branch lines are not parallel with each other, both open ends of the coupling branch lines or one of the open ends of the coupling branch lines is located in the vicinity of closest portions of the coupling branch lines;

that there are disposed second coupling conductors, the second coupling conductors comprising a pair of coupling branch lines connected to the second antenna conductor and extending inward from the second antenna conductor, and the coupling branch lines have open ends disposed so as to be adjacent to each other and to be capacitively coupled to each other;

that when the coupling branch lines are parallel with each other or in alignment with each other, both open ends of the coupling branch lines are closest portions with respect to each other; and that when the coupling branch lines are not parallel with each other, both open ends of the coupling branch lines or one of the open ends of the coupling branch lines is located in the vicinity of closest portions of the coupling branch lines.

The present invention also provides a planar antenna for a circularly polarized wave, comprising a dielectric substrate having a first antenna conductor in a loop shape and a second antenna conductor in a loop shape disposed so as to be adjacent to each other;

characterized in that there are disposed first coupling conductors, the first coupling conductors comprising a pair of coupling branch lines connected to the first antenna conductor and extending inward from the first antenna conductor, and the coupling branch lines have open ends disposed so as to be adjacent to each other and to be capacitively coupled to each other; and that the second antenna conductor has a pair of coupling branch lines connected thereto and extending inward therefrom, the coupling branch lines serving as second coupling conductors, and the coupling branch lines are capacitively coupled to each other.

The present invention also provides a planar antenna for a circularly polarized wave, comprising a dielectric substrate having a first antenna conductor in a loop shape and a second antenna conductor in a loop shape disposed so as to be adjacent to each other wherein power is fed from the first antenna conductor in a loop shape and the second antenna conductor in a loop shape; characterized in:

that there is provided means for capacitively coupling a first point of the first antenna conductor and a second point of the first antenna conductor except for the first point; and there is provided means for capacitively coupling a first point of the second antenna conductor and a second point of the second antenna conductor except for the first point.

The present invention also provides a planar antenna comprising a dielectric substrate having a first antenna conductor in a loop shape and a second antenna conductor in a loop shape disposed so as to be adjacent to each other; characterized in:

that the first antenna conductor has a first branch line connected thereto and extending inward therefrom, and no branch line close to the first branch line is disposed inside the first antenna conductor;

that the second antenna conductor has a second branch line connected thereto and extending inward therefrom, and no branch line close to the second branch line is disposed inside the second antenna conductor;

that each of the first branch line and the second branch line has an open end;

that when a length of the first branch line is called Lb1, and a length of the second branch line is called $L_{b2}$;

when an entire length of the second antenna conductor in a loop shape is called $L_{L1}$, and when an entire length of the first antenna conductor in a loop shape is called $L_{L2}$, formulae of $0.130 \leqq L_{b1}/L_{L1}$ and $0.130 \leqq L_{b2}/L_{L2}$ are satisfied; and that a shortest distance between the first antenna conductor and the open end of the first branch line is not shorter than 0.1 mm, and a shortest distance between the second antenna conductor and the open end of the second branch line is not shorter than 0.1 mm.

The present invention also provides a planar antenna for a circularly polarized wave, comprising a dielectric substrate having a first antenna conductor in a loop shape and a second antenna conductor in a loop shape disposed so as to be adjacent to each other; characterized in:

that there is a first auxiliary line, which capacitively couples a first point of the first antenna conductor and a second point of the first antenna conductor except for the first point; and that there is a second auxiliary line, which capacitively couples a first point of the second antenna conductor and a second point of the second antenna conductor except for the first point; and that when an imaginary line connecting between a center of gravity of the first antenna conductor and a center of gravity of the second antenna conductor is called a transverse line, the first auxiliary line and the second auxiliary line are symmetrical or substantially symmetrical with each other about a central point of the transverse line.

The present invention also provides a planar antenna comprising a first antenna conductor and a second antenna conductor, the first antenna conductor including a capacitive coupling portion formed by cutting out a portion of a loop conductor by a length, and the second antenna conductor including a capacitive coupling portion formed by cutting out a portion of a loop conductor by a length, characterized in:

that the first antenna conductor and the second antenna conductor are disposed on a window glass sheet for a vehicle so as to be adjacent to each other;

that when a radio wave for communication has a wavelength of $\lambda_0$ in air, when a shortest distance between the first antenna conductor and a vehicle opening edge is $L_1$, and when a shortest distance between the second antenna conductor and the vehicle opening edge is $L_2$, the following formulae are satisfied:

$$0.10 \leq L_1/\lambda_0 \text{ and } 0.10 \leq L_2/\lambda_0$$

and;

that a shortest distance between a portion of the planar antenna farthest from the vehicle opening edge and the vehicle opening edge is not longer than 200 mm.

The present invention also provides a planar antenna comprising a first antenna conductor and a second antenna conductor, the first antenna conductor including a capacitive coupling portion formed by cutting out a portion of a loop conductor by a length, and the second antenna conductor including a capacitive coupling portion formed by cutting out a portion of a loop conductor by a length, characterized in:

that the first antenna conductor and the second antenna conductor are disposed on a window glass sheet for a vehicle so as to be adjacent to each other;

that when an imaginary line connecting between a center of gravity of the first antenna conductor and a center of gravity of the second antenna conductor is called a transverse line, an angle included between a vehicle opening edge closest to the planar antenna and the transverse line is from 45 to 135 deg;

that when a radio wave for communication has a wavelength of $\lambda_0$ in air, and when a shortest distance between the planar antenna and the vehicle opening edge is $L_3$, the following formula is satisfied:

$$0.04 \leq L_3/\lambda_0$$

and that a shortest distance between a portion of the planar antenna farthest from the vehicle opening edge and the vehicle opening edge is not longer than 200 mm.

The present invention also provides a planar antenna for a circularly polarized wave, comprising a dielectric substrate having a first antenna conductor in a loop shape and a second antenna conductor in a loop shape disposed so as to be adjacent to each other;

characterized in that the dielectric substrate is a window glass sheet for vehicles;

that when a radio wave for communication has a wavelength of $\lambda_0$ in air, when a shortest distance between the first antenna conductor and a vehicle opening edge is $L_1$, and when a shortest distance between the second antenna conductor and the vehicle opening edge is $L_2$, the following formulae are satisfied:

$$0.10 \leq L_1/\lambda_0 \text{ and } 0.10 \leq L_2/\lambda_0$$

and;

that a shortest distance between a portion of the planar antenna farthest from the vehicle opening edge and the vehicle opening edge is not longer than 200 mm.

The present invention also provides a planar antenna for a circularly polarized wave, comprising a dielectric substrate having a first antenna conductor in a loop shape and a second antenna conductor in a loop shape disposed so as to be adjacent to each other;

characterized in that the dielectric substrate is a window glass sheet for a vehicle;

that when an imaginary line connecting between a center of gravity of the first antenna conductor and a center of gravity of the second antenna conductor is called a transverse line, an angle included between a vehicle opening edge closest to the planar antenna and the transverse line is from 45 to 135 deg;

that when a radio wave for communication has a wavelength of $\lambda_0$ in air, and when a shortest distance between the planar antenna and the vehicle opening edge is $L_3$, the following formulae are satisfied:

$$0.04 \leq L_3/\lambda_0$$

and that a shortest distance between a portion of the planar antenna farthest from the vehicle opening edge and the vehicle opening edge is not longer than 200 mm.

The present invention offers a superior communication property to a circularly polarized wave since both open ends of the paired coupling branch lines of the first capacitive coupling conductors, which are connected to the first antenna conductor in a loop shape, are adjacent to each other and are capacitively coupled to each other, and since both open ends of the paired coupling branch lines of the second capacitive coupling conductors, which are connected to the second antenna conductor in a loop shape, are adjacent to each other and are capacitively coupled to each other.

In particular, when both open ends of the paired coupling branch lines are closest portions with respect to each other, or when both open ends of the paired coupling branch line are located in the vicinity of closed portions of the paired coupling branch line in a case wherein the paired coupling branch lines are close to each other, it is possible to significantly improve the communication property of a circularly polarized wave.

Figure 1:
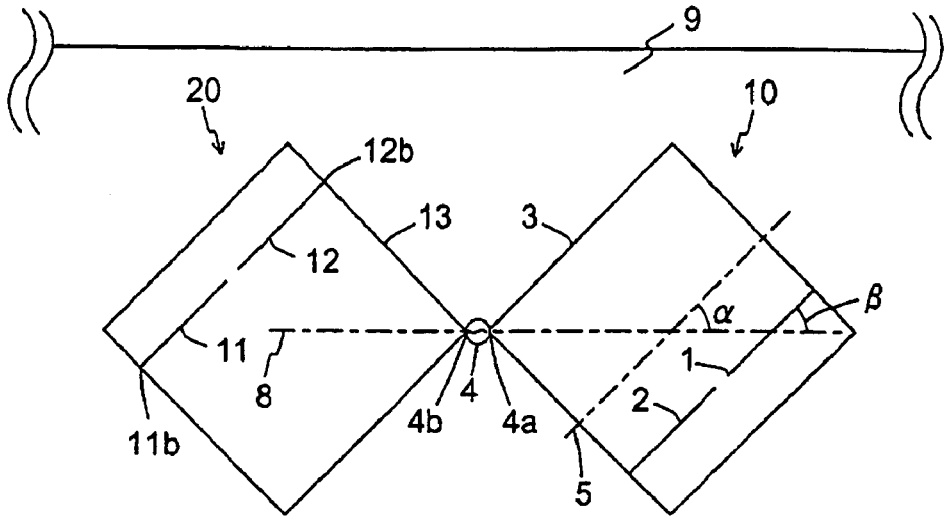
FIG. 1 is a plan view of a planar antenna according to an embodiment of the present invention, wherein one side of a dielectric substrate with antenna conductors disposed thereon is viewed.
Figure 2:
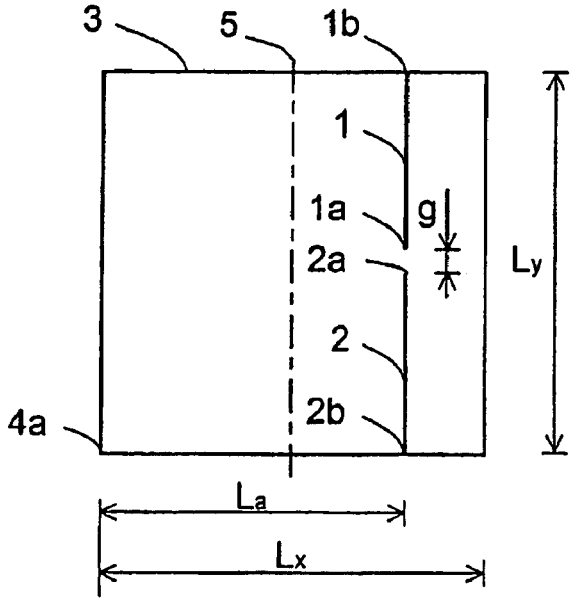
FIG. 2 is a plan view showing a right portion of the embodiment shown in FIG. 1.

Now, the planar antenna according to the present invention will be described in detail based on appropriate embodiments shown in the accompanying drawings. FIG. 1 is a plan view of the planar antenna according to an embodiment of the present invention, which shows one side of a dielectric substrate having antenna conductors. In FIG. 1 and other figures, explanation of directions will be made based on directions on the drawings. FIG. 2 is a plan view wherein a right portion of the embodiment shown in FIG. 1 is slightly enlarged.

FIGS. 1 and 2, reference numerals 1 and 2 designates a pair of coupling branch lines, reference numeral 1*a* designates an open end of the coupling branch line 1, reference numeral 1*b* designates a junction point between a first antenna conductor 3 and the coupling branch line 1, reference numeral 2*a* designates an open end of the coupling branch line 2, and reference numeral 2*b* designates a junction point between the first antenna conductor 3 and the coupling branch line 2. The paired coupling lines 1 and 2 form first capacitive coupling conductors. The paired junction points 1*b* and 2*b* form first junction portions.

In FIGS. 1 and 2, reference numeral 4 designates a power source, reference numeral 4*a* designates a first feeding point of the first antenna conductor 3, reference numeral 4*b* designates a second feeding point of a second antenna conductor 13, reference numeral 5 designates a first straight line, which passes through the center of gravity of a quadrangle defined by the first antenna conductor 3 (a chain line in FIG. 1), reference numeral 8 designates a transverse line (a chain line in FIG. 1), reference numeral 9 designates the dielectric substrate (or a window glass sheet), reference numeral 10 designates a first loop element comprising the first antenna conductor 3 and the paired coupling branch lines 1 and 2, reference numeral 13 designates the second antenna conductor, reference numerals 11 and 12 designate a pair of coupling branch lines, reference numeral 11*b* designates a junction point between the second antenna conductor 13 and the coupling branch line 11, and reference numeral 12*b* designates a junction point between the first antenna conductor 13 and the coupling branch line 12. The paired junction points 11*b* and 12*b* form second junction portions.

It is assumed that there is an imaginary line, which connects between the center of gravity of the first antenna conductor 3 and the center of gravity of the second antenna conductor 13. This imaginary line is called the transverse line 8. In FIG. 1, the transverse line 8 is shown, extending beyond both centers of gravity.

In FIGS. 1 and 2, reference numeral 20 designates a second loop element comprising the first antenna conductor 13 and the paired coupling branch lines 11 and 12, reference g designates the distance between the open end 1*a* and the open end 2*a*, reference La designates the shortest distance between the feeding point 4*a* and the first capacitive coupling conductors, and references $L_X$ and $L_Y$ designate the lengths of one side of the quadrangle or a substantially quadrangle defined by the first antenna conductor 3. The paired coupling branch lines 11 and 12 form second capacitive coupling conductors.

In FIGS. 1 and 2, reference a designates an angle included between the first straight line 5 and the transverse line 8 or an angle included between the transverse line 8 and the second straight line (straight line corresponding to the first straight line 5 on the side of the second loop element 20), and reference β designates an angle included between the first capacitive coupling conductors and the transverse line 8. Although the dielectric substrate 9 is shown in the embodiment of FIG. 1, the dielectric substrate 9 is omitted in embodiments of the figures other than FIG. 1. In the embodiment of FIG. 1, the dielectric substrate 9 is viewed from an interior side when being used as a window glass sheet for a vehicle. FIG. 1 may be called a schematic view of an interior side of the antenna.

It is preferred in terms of improved communication property that the first loop element 10 and the second loop element 20 be formed in the same shape, substantially the same shape as, or a similar shape to each other when ignoring the directions of both loop elements of the dielectric substrate 9. In FIGS. 1, 3 to 9 and 11, the first loop element 10 and the second loop element 20 are formed in the same shape as each other. In the following explanation, only the specifications for the shape and the dimensions in connection with the first loop element 10 will be explained in some cases. In those cases, the specifications for the shape and the dimensions in connection with the first loop element 10 are also applicable to the second loop element 20 since explanation will be made on the assumption that the first loop element 10 and the second loop element 20 are formed in the same shape and dimensions as each other.

In a case of $\lambda_g=\lambda_0 \cdot k$ wherein a radio wave for communication has a wavelength of $\lambda_0$ in air, and the material of the dielectric substrate 9 has a shortening coefficient of wavelength of k, both formulae of $g_1/\lambda_g \leqq 0.034$ and $g_2/\lambda_g \leqq 0.034$ are preferably satisfied wherein the paired coupling branch lines 1 and 2 has a shortest distance of $g_1$ therebetween, and the paired coupling branch lines 11 and 12 has a shortest distance of $g_2$ therebetween. Both values of $g_1/\lambda_g$ and $g_2/\lambda_g$ are more preferably in a range of not higher than 0.024, and both values of $g_1/\lambda_g$ and $g_2/\lambda_g$ are particularly preferably in a range of not higher than 0.016. It is supposed that $\lambda_g$ is the wavelength of a radio wave on the dielectric substrate 9. In consideration of not only prevention of short circuit due to migration but also easy production, the distance $g_1$ is preferably not shorter than 0.1 mm, and the distance $g_2$ is preferably not shorter than 0.1 mm. When the dielectric substrate 9 is a window glass sheet, k is normally equal to 0.54.

Figure 27:
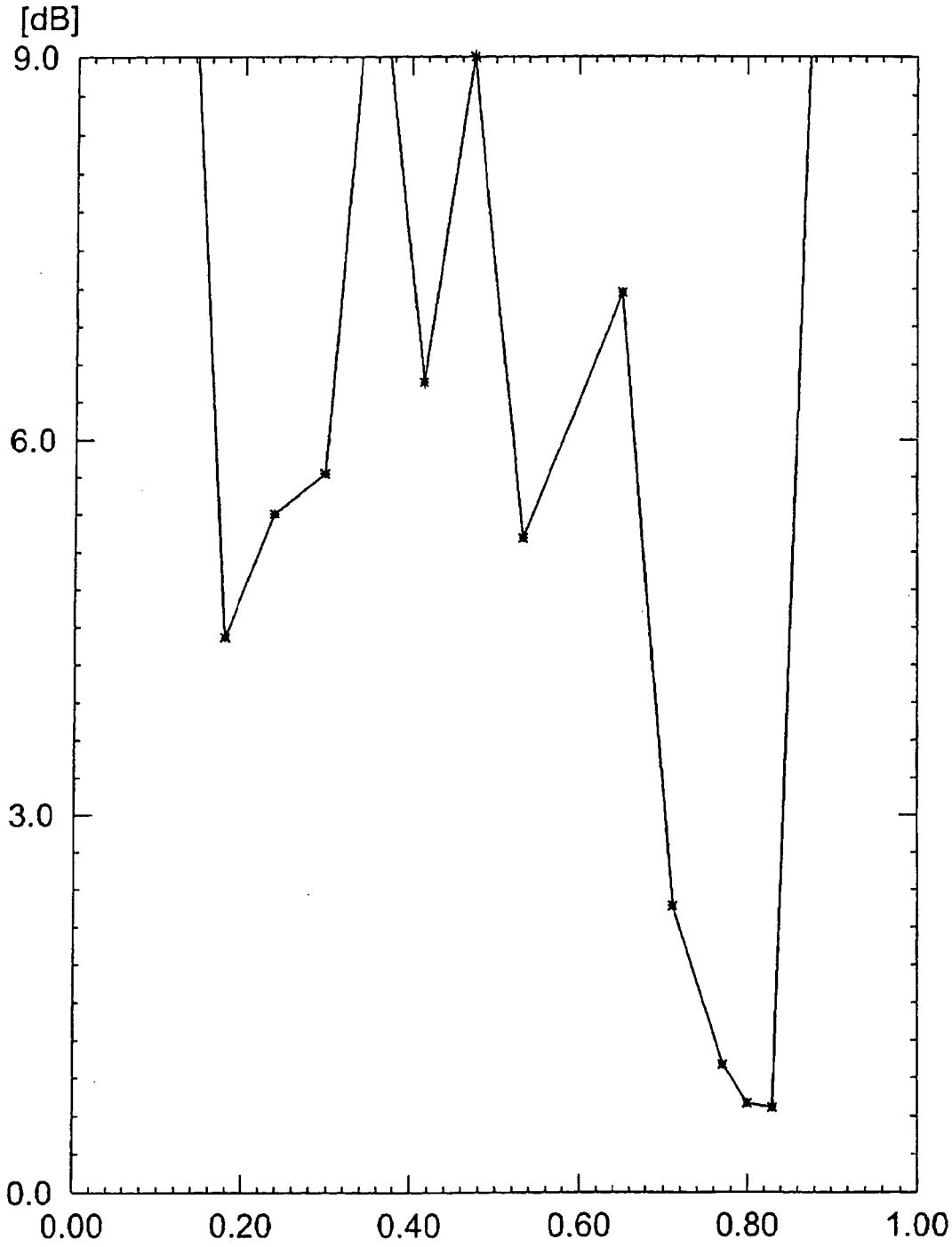
FIG. 27 is a diagram of a characteristic curve in Example 6 with La being varied, wherein the horizontal axis represents $L_a/\lambda_x$, and the vertical axis represents axial ratios.

When the shape defined by each of the first antenna conductor 3 and the second antenna conductor 13 is a quadrangle or substantially quadrangle as shown in FIG. 1, it is preferred that the formula of $0.66 \leqq L_a/L_X \leqq 0.86$ be satisfied. As shown in FIG. 27 stated later, it is possible to improve axial ratios in this range in comparison with other ranges. A more preferred range is $0.68 \leqq L_a/L_X \leqq 0.85$, and a particularly preferred range is $0.70 \leqq L_a/L_X \leqq 0.84$.

In the planar antenna according to the present invention, the dielectric substrate 9 has the first antenna conductor 3 in a loop shape and the second antenna conductor 13 in a loop shape provided adjacent to each other. When the planar antenna according to the present invention is used as a receiving antenna, power is fed from the first antenna conductor and the second antenna conductor. When the planar antenna according to the present invention is used as a transmitting antenna, power is fed to the first antenna conductor and the second antenna conductor. In other words, communication is performed, making use of a potential difference between the first loop element 10 and the second loop element 20. In Description, the word "communication" means at least one of transmittance and reception.

In the embodiment shown in FIG. 1, there is provided the first capacitive coupling conductors, which comprise the paired coupling branch lines 1 and 2 connected to the first antenna conductor 3 and extending inwardly from the first antenna conductor 3. Additionally, the open ends of the paired coupling branch lines 1 and 2 are close to each other and are capacitively coupled each other. Since the paired coupling branch lines 1 and 2 are parallel to or in alignment with each other, the respective open ends 1*a* and 2*a* of the paired coupling branch lines 1 and 2 are closest portions of the paired coupling branch lines.

Although not shown in FIG. 1, when the coupling branch lines 1 and 2 are not parallel with each other, the respective open ends 1*a* and 2*a* of the paired coupling branch lines 1 and 2 are positioned in the vicinity of closest portions of the paired coupling branch lines 1 and 2, or one of the open ends 1*a* and 2*a* of the paired coupling branch lines 1 and 2 is positioned in the vicinity of closest portions of the paired coupling branch lines 1 and 2.

Supposing that the paired coupling branch lines 1 and 2 extend toward the respective open ends 1*a* and 2*a*, it is preferred in terms of improved communication property that the paired coupling branch lines be positioned in such a positional relationship that the respective extensions collide with each other and connected to each other. However, the present invention is not limited to this arrangement. Even if none of the extensions collide with each other or be connected to each other since both extensions are out of alignment with each other, the planar antenna according to the present invention is usable as long as the open end 1*a* and the open end 2*a* are close to each other and are capacitively coupled each other, and as long as the open end 1*a* and the open end 2*a* are positioned at the closest portions since the paired coupling branch lines 1 and 2 are close to each other.

Although it is preferred in terms of improved communication property that the paired coupling branch lines 1 and 2 are in alignment with or substantially alignment with each other, the present invention is not limited to this arrangement. The planar antenna according to the present invention is usable even if the paired coupling branch lines 1 and 2 are out of alignment or out of substantially alignment with each other. Although it is preferred in terms of improved communication property that the second loop element 20 be positioned so as to be symmetrical or substantially symmetrical with the first loop element 10 about the central point between the first feeding point 4*a* and the second feeding point 4*b*, the present invention is not limited to this arrangement. Even if the second antenna conductor 13 is not positioned so as to be symmetrical or substantially symmetrical with the first antenna conductor 3, the planar antenna according to the present invention is usable.

In FIGS. 1, 3 to 9 and 11, the first antenna conductor 3 and the second antenna conductor 13 are disposed so that the center of gravity of the first antenna conductor 3, the first feeding power point 4*a*, the second feeding power point 4*b* and the center of gravity of the second antenna conductor 13 are in alignment or substantially alignment with one another.

In the embodiment shown in FIG. 1, the transverse line 8 passes through the center of gravity of the first antenna conductor 3, the first feeding point 4*a*, the second feeding point 4*b* and the center of gravity of the second antenna conductor 13.

In Description, the center of gravity of the first antenna conductor 3 means the center of gravity of the shape defined by only the first antenna conductor 3 without containing the first capacitive coupling conductors. The center of gravity of the second antenna conductor 13 means the center of gravity of the shape defined by only the second antenna conductor 13 without containing the second capacitive coupling conductors.

The shape defined by the first antenna conductor 3 is symmetrical or substantially symmetrical with respect to the first straight line 5. Additionally, the shape defined by the second antenna conductor 13 is symmetrical or substantially symmetrical with respect to the second straight line. It is preferred in terms of improved communication property that the angle $\alpha$ included between the first straight line and the transverse line 8 or the angle $\alpha$ included by the second straight line and the transverse line be from 30 to 60 deg, and that the first straight line 5 and the second straight line are parallel or substantially parallel with each other. However, the present invention is not limited to this arrangement. Even if the shape defined by the first antenna conductor 3 is not symmetrical or substantially symmetrical with respect to the first straight line, and even if the shape defined by the second antenna conductor 13 is not symmetrical or substantially symmetrical with respect to the second straight line, the planar antenna according to the present invention is usable. The angle $\alpha$ more preferably ranges from 40 to 50 deg. It is preferred in terms of improved communication property of a circularly polarized wave that the first feeding point 4*a* and the second feeding point 4*b* be disposed on the transverse line 8 or in the vicinity of the transverse line 8.

In a case wherein the transverse line 8 is linear or substantially linear, wherein the electric field generated by a circularly polarized wave of a radio wave is counterclockwise rotated in a viewing direction, which is a direction for the radio wave to come or for a radio wave to be radiated from the planar antenna according to the present invention, and wherein the coupling branch lines 1 and 2 are disposed in alignment of in substantially alignment with each other; the angle $\beta$ included between each of the first capacitive coupling conductors and the transverse line preferably ranges from 30 to 60 deg when the transverse line 8 is clockwise viewed from the first capacitive coupling conductors in the viewing direction. When the angle $\beta$ is from 30 to 60 deg, axial ratios can be improved in comparison with a case wherein the angle $\beta$ is out of the range of from 30 to 60 deg. The angle $\beta$ more preferably ranges from 40 to 50 deg.

In a case wherein the transverse line 8 is linear or substantially linear, wherein the electric field generated by a circularly polarized wave of a radio wave is clockwise rotated in a viewing direction, which is a direction for the ratio wave to come or for the radio wave to be radiated from the planar antenna according to the present invention, and wherein the coupling branch lines 1 and 2 are disposed in alignment or in substantially alignment with each other, the angle $\beta$ included between each of the first capacitive coupling conductors and the transverse line 8 preferably ranges from 120 to 150 deg when the transverse line 8 is clockwise viewed from the first capacitive coupling conductors in the viewing angle. When the angle $\beta$ is from 120 to 150 deg, axial ratios can be improved in comparison with a case wherein the angle $\beta$ is out of the range of from 120 to 150 deg. The angle $\beta$ more preferably ranges from 130 to 140 deg.

In the present invention, it is preferred in terms of improved communication property that the first capacitive coupling conductors and the second capacitive coupling conductors be parallel or in substantially parallel with each other.

It is preferred in terms of improved axial ratio that the respective first junction portions be disposed on the same side as each other with respect to the first straight line 5, and that the respective junction portions be disposed on the same side as each other with respect to the second straight line. Additionally, it is preferred in terms of improved axial ratio that the first junction portions be remote from the first straight line 5 and be disposed at portion except for the first straight line 5, and that the second junction portions be remote from the second straight line and be disposed at portions except for the second straight line.

When the shape defined by the first antenna conductor 3 and the shape defined by the second antenna conductor 13 are both a polygon or substantially polygon, it is preferred in terms of improved communication property that the first feeding point 4*a* is disposed at or in the vicinity of the vertex of one of angles of the shape defined by the first antenna conductor 3, and that the second feeding point 4*b* be disposed at or in the vicinity of the vertex of one of angles of the shape defined by the second antenna conductor 13.

As the shape defined by the first antenna conductor 3 and the shape defined by the second antenna conductor 13, a triangle, a substantially triangle, a quadrangle, a substantially quadrangle, a circle, a substantially circle, an ellipse, a substantially ellipse or the like is applicable. Among these shapes, a square or a substantially square is preferred in terms of improved axial ratio.

Figure 3:
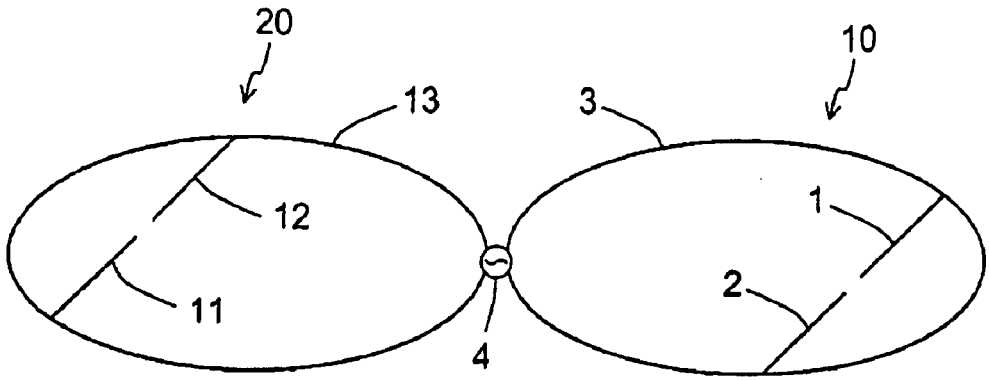
FIG. 3 is a plan view of the planar antenna according to another example, which is different from the embodiment shown in FIG. 1.
Figure 4:
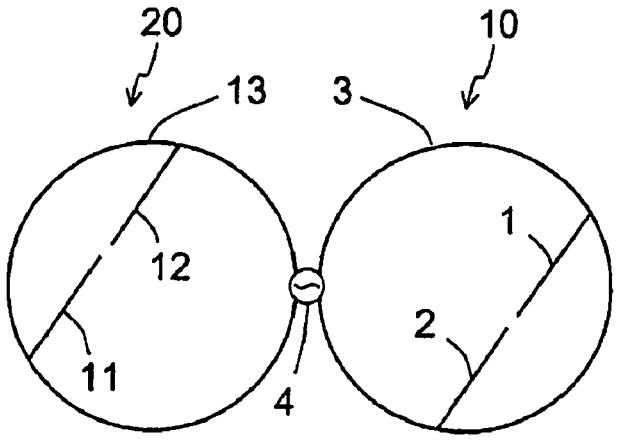
FIG. 4 is a plan view of the planar antenna according to another example, which is different from the embodiment shown in FIG. 1.
Figure 5:
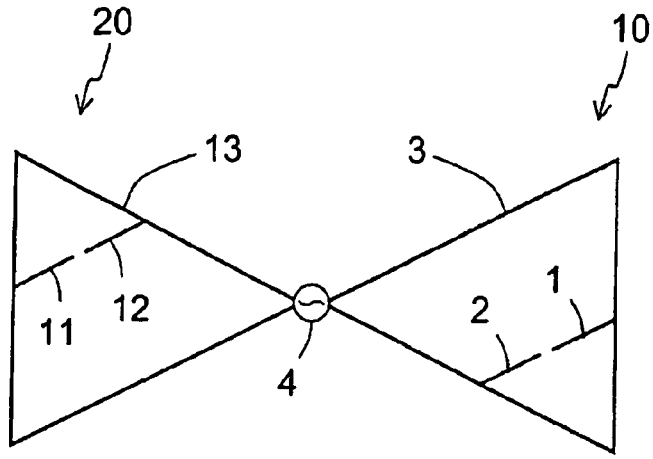
FIG. 5 is a plan view of the planar antenna according to another example, which is different from the embodiment shown in FIG. 1.
Figure 6:
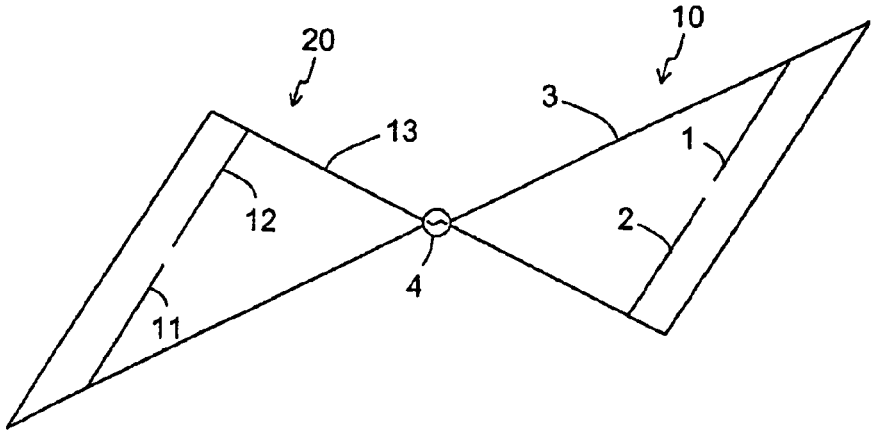
FIG. 6 is a plan view of the planar antenna according to another example, which is different from the embodiment shown in FIG. 1.

Examples wherein the shape defined by the first antenna conductor 3 and the shape defined by the second antenna conductor 13 are both squares are shown in FIGS. 1, 2, 7 and 9. An example wherein both shapes are ellipses is shown in FIG. 3. An example wherein both shapes are circles are shown in FIG. 4. Examples wherein both shapes are triangles are shown in FIGS. 5 and 6. An example wherein both shapes are rectangles is shown in FIG. 8.

In the present invention, when the shape defined by the first antenna conductor 3 is a polygon or substantial polygon having a larger even number of angles than a triangle, and when the shape defined by the second antenna conductor 13 is a polygonal or substantial polygonal having a larger even number of angles than a triangle, an angle of the first antenna conductor 3 with a feeding point disposed thereat is called a first power feeding angle, and a diagonal, which connects between the vertex having the first power feeding angle and the vertex having an opposite angle closest to the straight line connecting between the center of gravity of the shape defined by the first antenna conductor and the vertex having the first power feeding angle, the closest opposite angle being selected from the opposite angles of the first power feeding angle, is called a first diagonal. Additionally, when an angle of the second antenna conductor 13 with a feeding point disposed thereat is called a second power feeding angle, and a diagonal, which connects between the vertex having the second power feeding angle and the vertex having an opposite angle closest to the straight line connecting between the center of gravity of the shape defined by the second antenna conductor and the vertex having the first power feeding angle, the closest opposite angle being selected from the opposite angles of the second power feeding angle, is called a second diagonal, it is preferred in terms of improved communication property that the first antenna conductor 3 and the second antenna conductor 13 be disposed so that the first diagonal and the second diagonal are in alignment or in substantial alignment with each other.

Additionally, when the shape defined by the first antenna conductor 3 is a polygonal or substantial polygonal, and when the shape defined by the second antenna conductor 13 is a polygonal or substantial polygonal, it is preferred in terms of improved communication property that the first capacitive coupling conductors be parallel with or substantially parallel with at least one side among sides being not consecutive to the first power feeding angle, and that that the second capacitive coupling conductors be parallel with or substantially parallel with at least one side among sides being not consecutive to the second power feeding angle.

In the embodiment shown in FIG. 1, the first feeding point 4*a* is disposed on the opposite side of the first junction portion with respect to the first straight line 5, and the second feeding point 4*b* is disposed on the opposite side of the second junction portion with respect to the second straight line. Additionally, the paired coupling branch lines 1 and 2 are disposed on the same side as each other with respect to the first straight line 5, and the paired coupling branch lines 11 and 12 are disposed on the same side as each other with respect to the second straight line.

Figure 7:
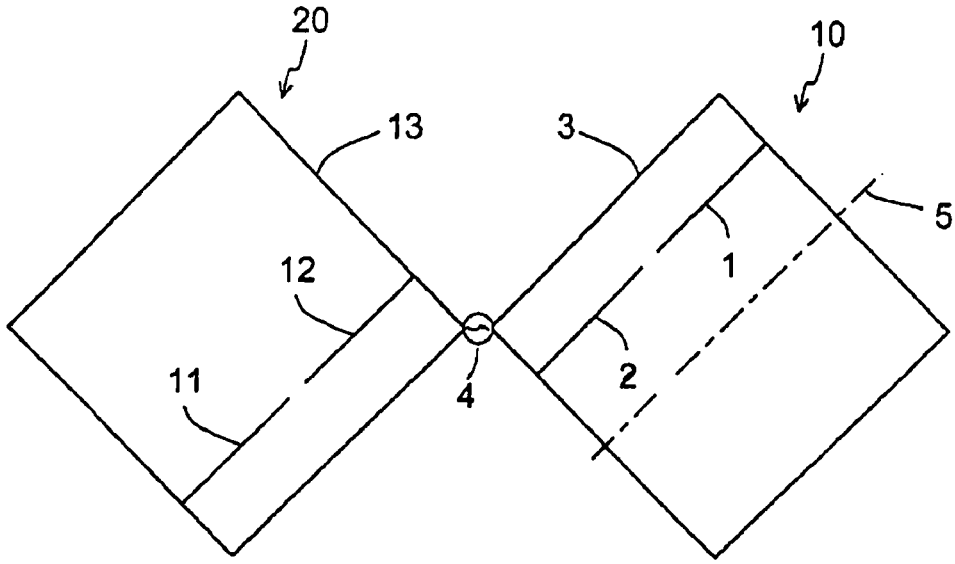
FIG. 7 is a plan view of the planar antenna according to another example, which is different from the embodiment shown in FIG. 1.
Figure 8:
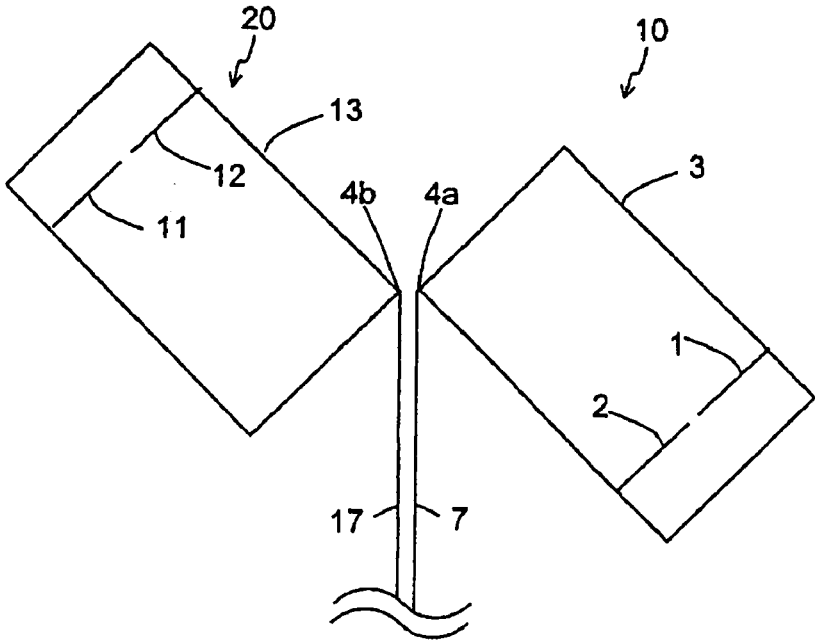
FIG. 8 is a plan view of the planar antenna according to another example, which is different from the embodiment shown in FIG. 1.
Figure 9:
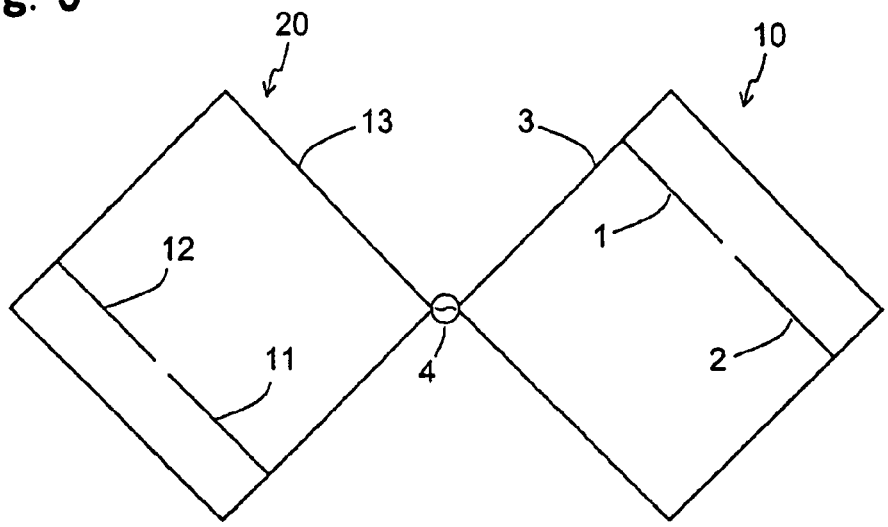
FIG. 9 is a plan view of the planar antenna according to another example, which is different from the embodiment shown in FIG. 1.

In the embodiment shown in FIG. 7, the first feeding point 4*a* is disposed on the same side as the first junction portion with respect to the first straight line 5, and the second feeding point 4*b* is disposed on the same side of the second junction portion with respect to the second straight line. Additionally, the paired coupling branch lines 1 and 2 are disposed on the same side as each other with respect to the first straight line 5, and the paired coupling branch lines 11 and 12 are disposed on the same side as each other with respect to the second straight line.

Figure 22:
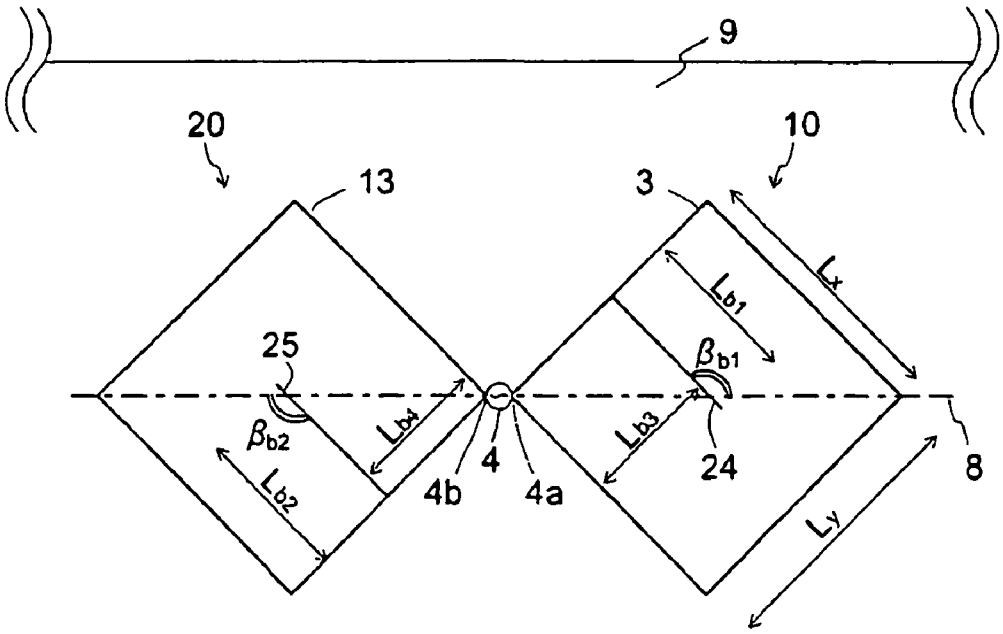
FIG. 22 is a plan view of another embodiment, which are different from the embodiments shown in FIGS. 1 to 9.
Figure 23:
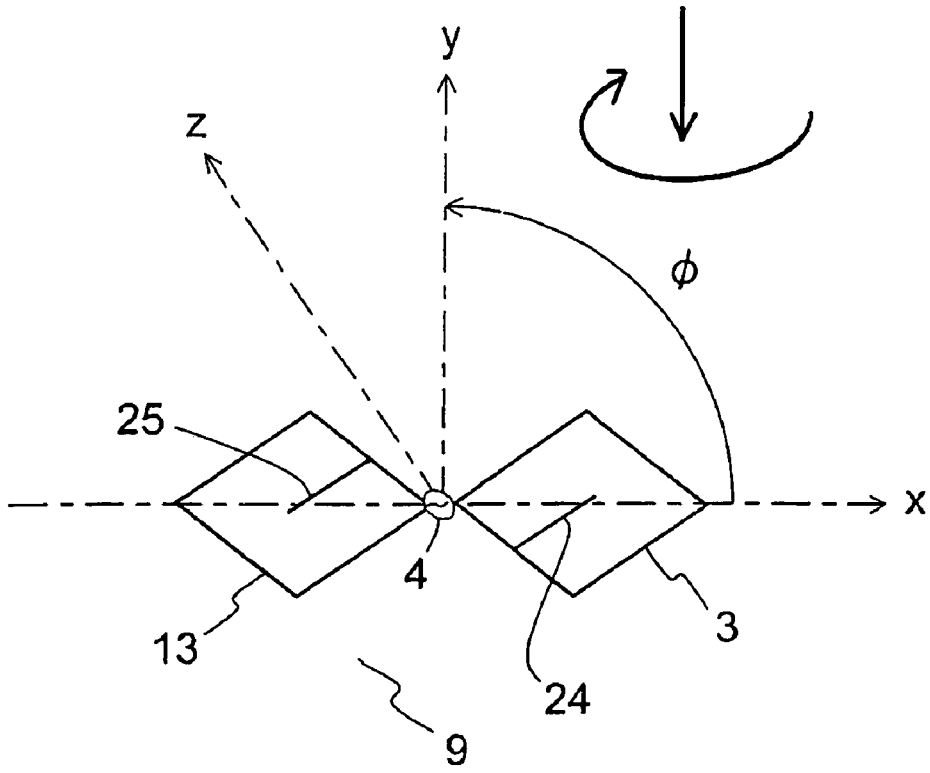
FIG. 23 is a schematic view in a case wherein the planar antenna shown in FIG. 22 is disposed on the x-z coordinate plane in an x, y and z coordinate.

FIGS. 22 and 23 show other embodiments, which are different from the embodiments shown in FIGS. 1 to 9. In FIG. 22, reference $L_{b1}$ designates the length of a first branch line 24, reference $L_{b2}$ designates the length of a second branch line 25, reference $L_{b3}$ designates the shortest distance between the first feeding point 4*a* and the first branch line 24, and reference $L_{b4}$ designates the shortest distance between the second feeding point 4*b* and the second branch line 25. The relationship between FIG. 22 and FIG. 23 is the same as that between FIG. 1 and FIG. 11 explained in detail later.

In the embodiment shown in FIG. 22, the dielectric substrate has a first antenna conductor 3 in a loop shape and a second antenna conductor 13 in a loop shape disposed so as to be close to each other. Additionally, the first branch line 24 is disposed so as to be connected to the first antenna conductor 3 and to extend inward from the first antenna conductor 3. No other branch line close to the first branch line 24 is disposed inside the first antenna conductor 3. Additionally, the second branch line 25 is disposed so as to be connected to the second antenna conductor 13 and to extend inward from the second antenna conductor 13. No other branch line close to the second branch line 25 is disposed inside the second antenna conductor 13. The phrase "close" means that when the shortest distance between close branch lines is defined as $g_3$, no other branch line is disposed around the first branch line 24 or the second branch line 25 within a distance of $g_3$, which is preferred in terms of improved communication property of a circularly polarized wave. With respect to $g_3$, it is preferred that the formula of $0.016 \leqq g_3/\lambda_g$ be satisfied, it is more preferred that the formula of $0.024 \leqq g_3/\lambda_g$ be satisfied, and it is particularly preferred that the formula of $0.034 \leqq g_3/\lambda_g$ be satisfied.

In the embodiment shown in FIG. 22, the first branch line 24 and the second branch line 25 have open ends, respectively, which is preferred in terms of improved communication property of a circularly polarized wave. However, the present invention is not limited to this arrangement. The planar antenna according to the present invention is usable as long as at least one of the first branch line 24 and the second branch line 25 has an open end. In the embodiment shown in FIG. 22, when an imaginary line connecting between the center of gravity of the first antenna conductor 3 and the center of gravity of the second antenna conductor 13 is called a transverse line 8, the first branch line 24 and the second branch line 25 are symmetrical or substantially symmetrical with each other about the center of the transverse line, which is preferred in terms of improved communication property of a circularly polarized wave.

In FIG. 22, when the transverse line 8 is linear or substantially linear, when the electric field generated by a circularly polarized wave of a radio wave is counterclockwise rotated in a viewing direction, which is a direction for the radio wave to come or for the radio wave to be radiated from the planar antenna according to the present invention, and when the transverse line 8 is clockwise viewed from the first branch line or the second branch line in the viewing direction; the angle $\beta_{b1}$ included between the first branch line 24 and the transverse line 8, and the angle $\beta_{b2}$ included between the second branch line 25 and the transverse line 8 preferably range from 120 to 150 deg, respectively. When the angles $\beta_{b1}$ and $\beta_{b2}$ range, respectively, from 120 to 150 deg, it is possible to improve axial ratios in comparison with a case wherein the angles $\beta_b$ are out of the range of from 120 to 150 deg. The angles $\beta_{b1}$ and $\beta_{b2}$ more preferably range from 130 to 140 deg.

In the embodiment shown in FIG. 22, when the electric field generated by a circularly polarized wave of a radio wave is clockwise rotated in the viewing direction, which is a direction for the radio wave to come or for the radio wave to be radiated from the planar antenna according to the present invention, and when the transverse line 8 is clockwise viewed from the first branch line 24 and the second branch line 25 in the viewing direction; the angle $\beta_{b1}$ included between the first branch line 24 and the transverse line 8, and the angle $\beta_{b2}$ included between the second branch line 25 and the transverse line 8 preferably range from 30 to 60 deg, respectively. When the respective angles $\beta_{b1}$ and $\beta_{b2}$ range from 30 to 60 deg, it is possible to improve axial ratios in comparison with a case wherein the respective angles $\beta_{b1}$ and $\beta_{b2}$ are out of the range of from 30 to 60 deg. The respective angles $\beta_{b1}$ and $\beta_{b2}$ more preferably range from 40 to 50 deg.

Figure 34:
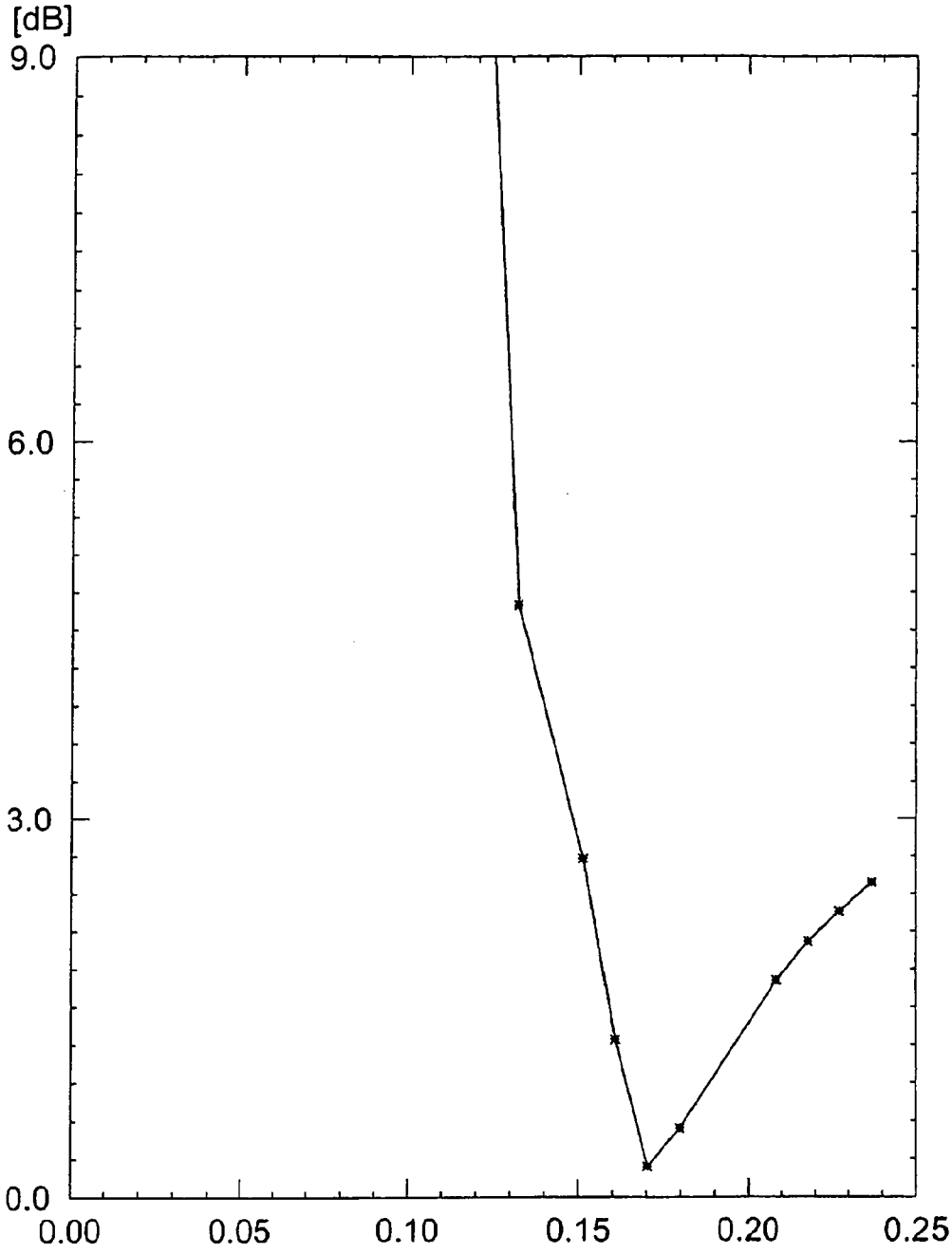
FIG. 34 is a diagram of a characteristic curve in Example 10, wherein the horizontal axis represents $((L_{b1}$ or $L_{b2})/(2\times(L_x+L_y)))$ and the vertical axis represents axial ratios.

In the embodiment shown in FIG. 22, when the entire length of the first antenna conductor 3 in a loop shape is defined as $L_{L1}$, and when the entire length of the second antenna conductor 13 in a loop shape is defined as $L_{L2}$, it is preferred that the formulae of $0.130 \leqq L_{b1}/L_{L1}$ and $0.130 \leqq L_{b2}/L_{L2}$ be satisfied. When the formulae are satisfied, the axial ratio of the antenna can be preferably improved as shown in FIG. 34 stated later.

It is more preferred that both formulae of $0.133 \leqq L_{b1}/L_{L1}$ and $0.133 \leqq L_{b2}/L_{L2}$ be satisfied. It is particularly preferred that both formulae of $0.148 \leqq L_{b1}/L_{L1}$ and $0.148 \leqq L_{b2}/L_{L2}$ be satisfied.

Further, it is preferred that the shortest distance between the first antenna conductor 3 and the open end of the first branch line 24 be not shorter than 0.1 mm, and that the shortest distance between the second antenna conductor 13 and the open end of the second branch line 25 be not shorter than 0.1 mm. When these requirements are met, it is difficult for short circuit due to migration to occur, and it is easier to produce the antenna.

Figure 24:
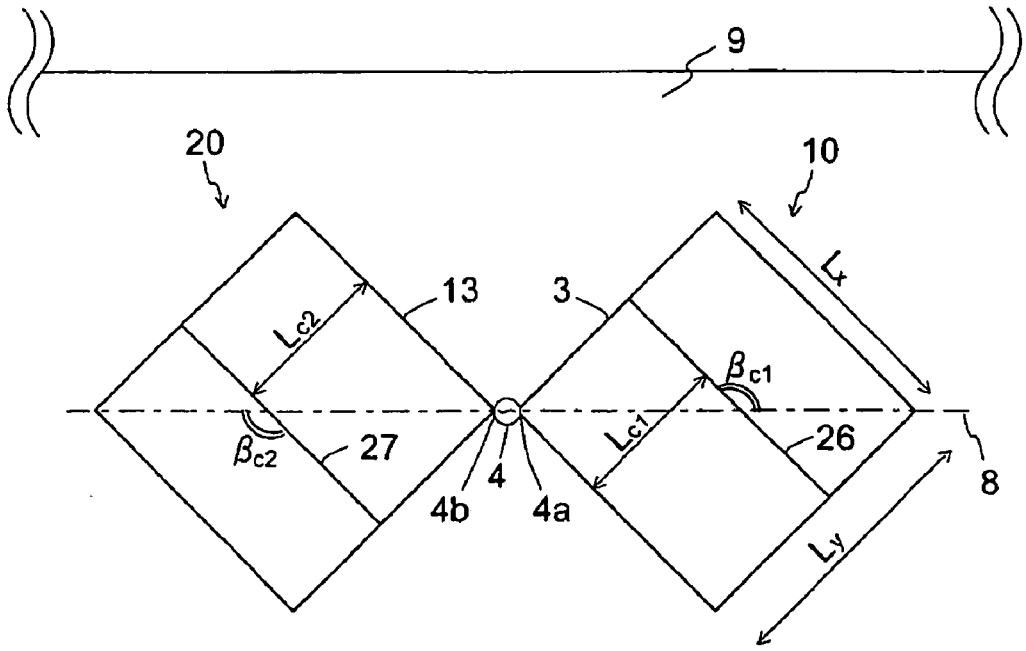
FIG. 24 is a plan view of another embodiment, which are different from the embodiments shown in FIGS. 1 to 9, 22 and 23.

FIG. 24 shows another embodiment, which is different from the embodiments shown in FIGS. 1 to 9, 22 and 23. In FIG. 24, the dielectric substrate has a first antenna conductor 3 in a loop shape and a second antenna conductor 13 in a loop shape disposed so as to be close to each other. As shown in FIG. 24, there is disposed a first auxiliary line 26, which connects a first point of the first antenna conductor 3 and a second point of the first antenna conductor 3 except for the first point. There is also disposed a second auxiliary line 27, which connects a first point of the second antenna conductor 13 and a second point of the second antenna conductor 13 except for the arbitrary point. When an imaginary line connecting between the center of gravity of the first antenna conductor 3 and the center of gravity of the second antenna conductor 13 is called a transverse line 8, the first auxiliary line 26 and the second auxiliary line 27 are symmetrical or substantially symmetrical with each other about the center of the transverse line, which is preferred in terms of improved communication property of a circularly polarized wave.

Figure 35:
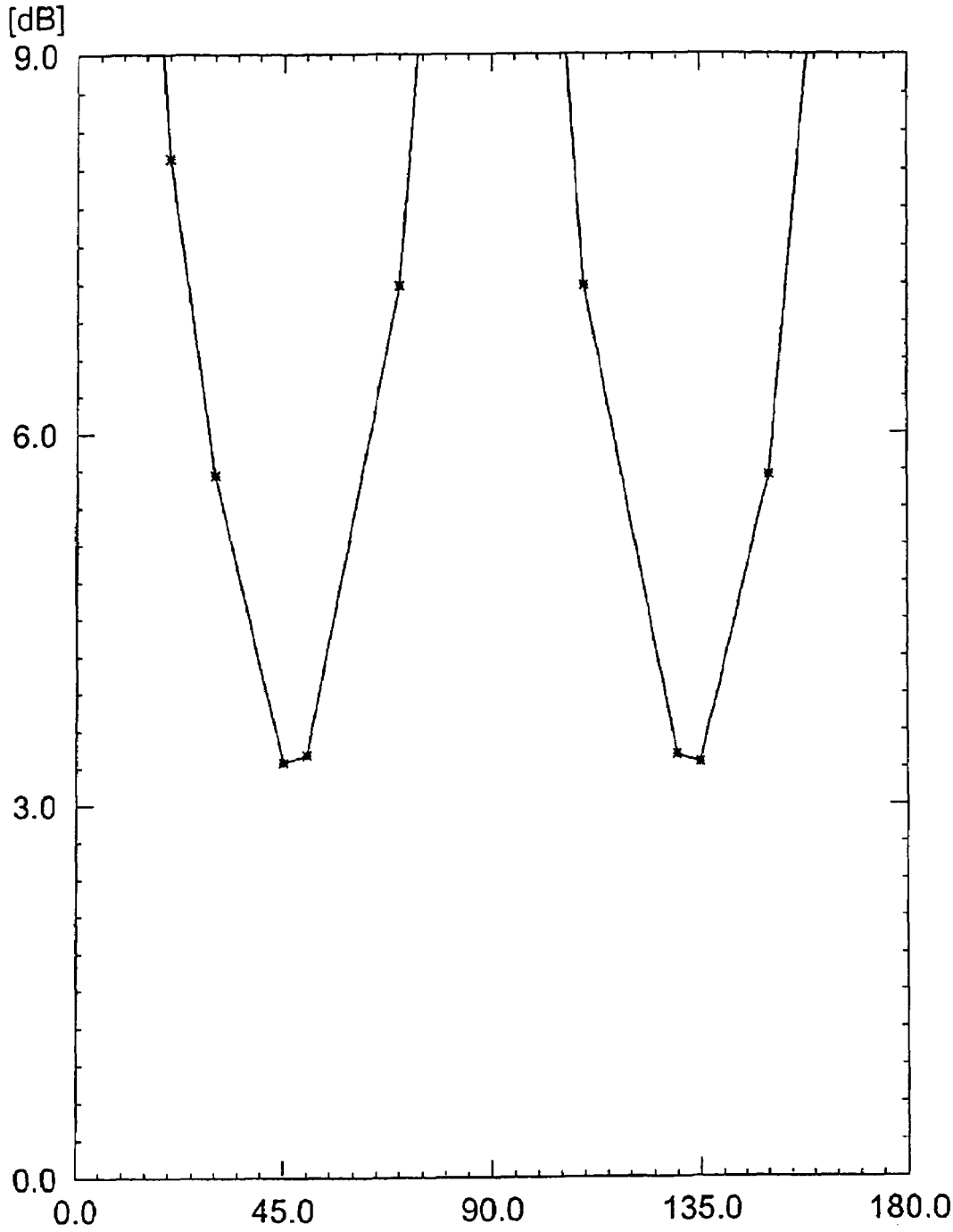
FIG. 35 is a diagram of a characteristic curve in Example 11, wherein the horizontal axis represents $\beta_{c1}(\beta_{c2})$, and the vertical axis represents axial ratios.

In the embodiment shown in FIG. 24, when the electric field generated by a circularly polarized wave of a radio wave is counterclockwise rotated in a viewing direction, which is a direction for the radio wave to come or for the radio wave to be radiated from the planar antenna shown in FIG. 24, and when the transverse line 8 is clockwise viewed from the first auxiliary line 26 in the viewing direction, the angle $\beta_{c1}$ included between the first auxiliary line 26 and the transverse line 8 preferably ranges from 116 to 152 deg in terms of improved axial ratio as shown in FIG. 35 stated later. In this case, the angle $\beta_{c1}$ preferably ranges from 124 to 143 deg. When the transverse line 8 is clockwise viewed from the second auxiliary line 27 in the viewing direction, the angle $\beta_{c2}$ included between the second auxiliary line 27 and the transverse line 8 preferably ranges from 116 to 152 deg in terms of improved axial ratio. In this case, the angle $\beta_{c2}$ more preferably ranges from 124 to 143 deg.

When the first auxiliary line 26 and the second auxiliary line 27 are linear or substantially linear, when the electric field generated by a circularly polarized wave of a radio wave is clockwise rotated in a viewing direction, which is a direction for the ratio wave to come or for the radio wave to be radiated from the planar antenna shown in FIG. 24, and when the transverse line 8 is clockwise viewed from the first auxiliary line 26 in the viewing angle, the angle $\beta_{c1}$ included between the first auxiliary line 26 and the transverse line 8 preferably ranges from 28 to 64 deg in terms of improved axial ratio as shown in FIG. 35 stated later. In this case, the angle $\beta_{c1}$ more preferably ranges from 37 to 56 deg. Additionally, when the transverse line 8 is clockwise viewed from the second auxiliary line 27 in the viewing direction, the angle $\beta_{c2}$ included between the second auxiliary line 27 and the transverse line 8 preferably ranges from 28 to 64 deg in terms of improved axial ratio as shown in FIG. 35 stated later. In this case, the angle $\beta_{c2}$ more preferably ranges from 37 to 56 deg.

Figure 25:
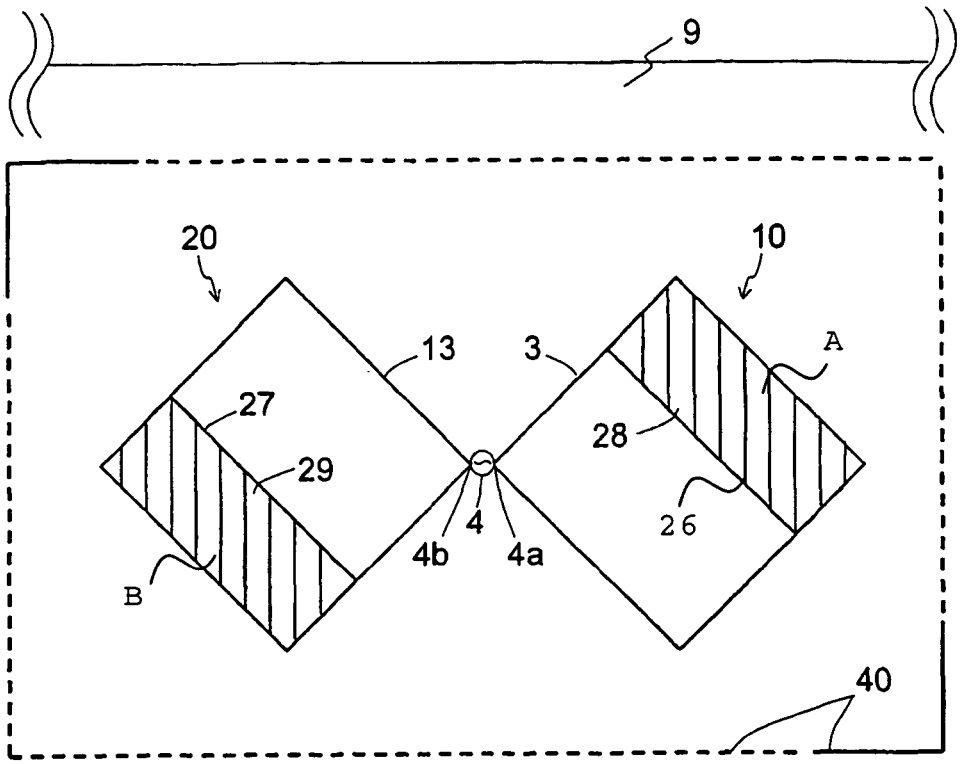
FIG. 25 is a plan view of another embodiment, which are different from the embodiments shown in FIGS. 1 to 9, 22 to 24.

FIG. 25 shows another embodiment, which is different from the embodiments shown in FIGS. 1 to 9 and 22 to 24. In the embodiment shown in FIG. 25, a first conductive film 28 is disposed in a region A, which is surrounded by a first antenna conductor 3 and a first auxiliary line 26, and which has no contact with a first feeding point 4*a*. Additionally, a second conductive film 29 is disposed in a region B, which is surrounded by a second antenna conductor 13 and a second auxiliary line 27, and which has no contact with a second feeding point 4*b*.

In consideration of improved productivity, it is preferred that the first antenna conductor 3 and the first auxiliary line 26 be integrally formed with the first conductive film 28 in the region A.

It is preferred that in consideration of improved productivity the second antenna conductor 13 and the second auxiliary line 27 be also integrally formed with the second conductive film 29 in the region B. It is preferred in terms of improved antenna gain that the first conductive film 28 and the second conductive film 29 be disposed in this way.

In the embodiment shown in FIG. 25, the conductive film is disposed in each of the entire region A and the entire region B, which is preferred in terms of improved antenna gain. However, the present invention is not limited to this arrangement. The planar antenna according to the present invention is usable as long as the conductive film is disposed in at least one portion of each of the region A and the region B.

An example of another embodiment is that a third conductive film is disposed in at least one portion of a region C (a region other than the region A), which is surrounded by the first antenna conductor 3 and the first auxiliary line 26, and which has contact with the first feeding point 4*a*, and that a fourth conductive film is disposed in at least one portion of a region D (a region other than the region B), which is surrounded by the second antenna conductor 13 and the second auxiliary line 27, and which has contact with the second feeding point 4*b*.

In consideration of improved productivity, it is preferred that the first antenna conductor 3 and the first auxiliary line 26 be integrally formed with the third conductive film in the region C. Additionally, it is preferred that the second antenna conductor 13 and the second auxiliary line 27 be integrally formed with the fourth conductive film in the region D. It is preferred in terms of improved antenna gain that the third conductive film and the fourth conductive film are disposed in this way.

In this embodiment, it is preferred in terms of improved antenna gain that the conductive film is disposed in the entire region C and the entire region D. However, the present invention is not limited to this arrangement. The planar antenna according to the present invention is usable as long as the conductive film is disposed in at least one portion of each of the region C and the region D.

In the present invention, when the shape defined by the first antenna conductor 3 is a polygon or substantially polygon, and when the shape defined by the second antenna conductor 13 is a polygonal or substantially polygonal, it is preferred in terms of improved communication property that the first straight line 5 be parallel or substantially parallel with at least one of sides being not consecutive with the first power feeding angle, and that the second straight line be parallel or substantially parallel with at least one of sides being not consecutive with the second power feeding angle.

It is preferred in terms of improved communication property that a first antenna conductor 3 and the second antenna conductor 13 be disposed so that a straight line, which connects the long axis of the ellipse formed by the first antenna conductor 3, a first feeding point 4*a* the long axis of the ellipse formed by the second antenna conductor 13, and a second feeding point 4*b*, is in alignment or substantially alignment as shown in FIG. 3.

Figure 15:
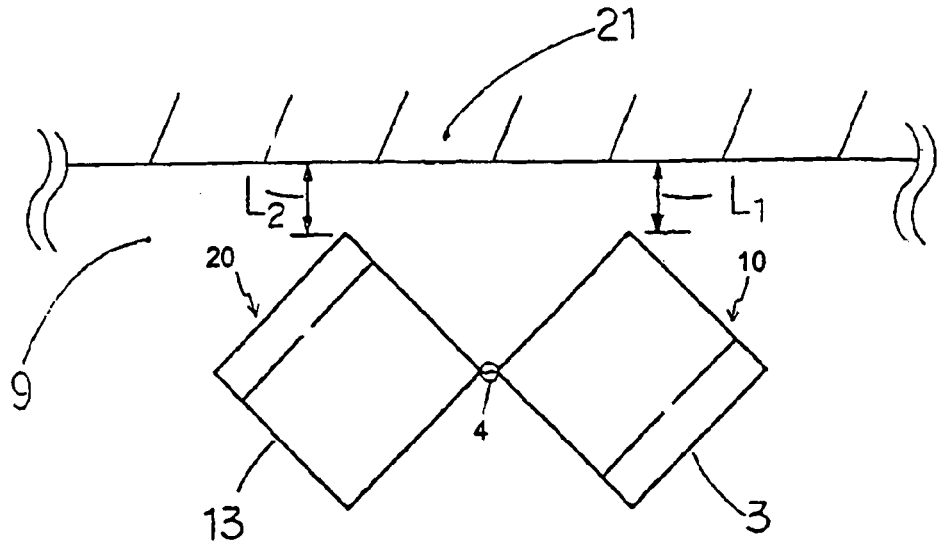
FIG. 15 is a plan view showing a case wherein the planar antenna shown in FIG. 1 is disposed in a region in the vicinity of a vehicle opening edge for a window glass sheet.

A case wherein the planar antenna according to the present invention is applied to a vehicle will be explained. FIG. 15 is an embodiment wherein the planar antenna shown in FIG. 1 is disposed in a region in the vicinity of a vehicle opening edge 21 for a window glass sheet 9. In FIG. 15, reference $L_1$ designates the shortest distance between the first antenna conductor 3 and the vehicle opening edge 21, and reference $L_2$ designates the shortest distance between the second antenna conductor 13 and the vehicle opening edge 21. In the present invention, the vehicle opening edge 21 is a peripheral edge of a vehicle opening to fit the window glass sheet 9 thereinto, and which serves as vehicle grounding and is made of a conductive material, such as metal.

Figure 17:
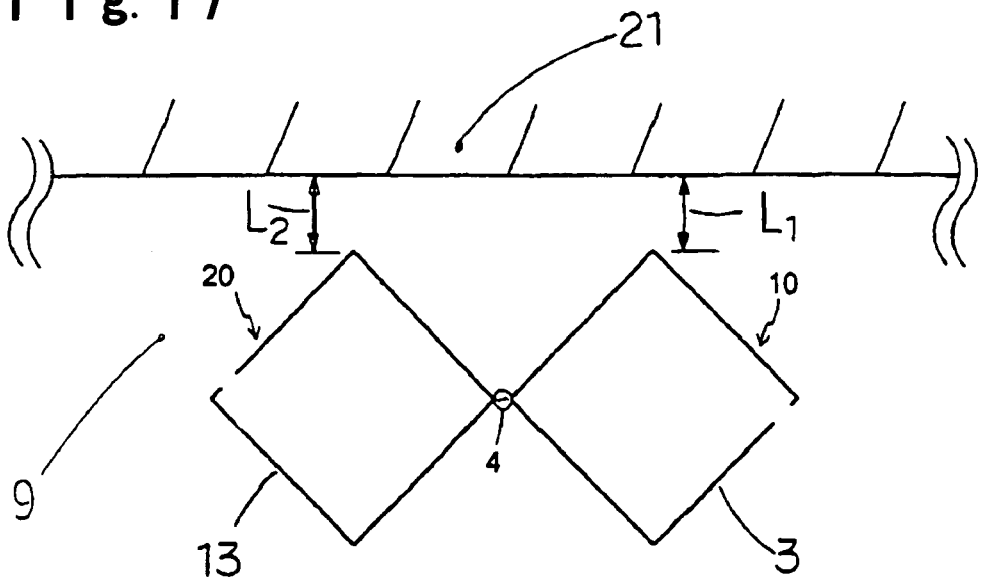
FIG. 17 is a plan view showing another embodiment of the present invention, which is different from the embodiments shown in FIGS. 1 and 15.

FIG. 17 is another embodiment of the present invention, which is different from the embodiments shown in FIGS. 1 and 15. The planar antenna shown in FIG. 17 comprises a first antenna conductor 3, which includes a capacitive coupling portion formed by removing a portion of a loop conductor by a certain length, and a second antenna conductor 13, which includes a capacitive coupling portion formed by removing a portion of a loop conductor by a certain length. Power is fed from the first antenna conductor 3 and the second antenna conductor 13, or power is fed to the first antenna conductor 3 and the second antenna conductor 13.

When the planar antenna according to the present invention is disposed in a region in the vicinity of the vehicle opening edge 21 for the window glass sheet 9 as shown in FIGS. 15 and 17, it is preferred in terms of improved antenna gain that both formulae of $0.10 \leqq L_1/\lambda_0$ and $0.10 \leqq L_2/\lambda_0$ be satisfied. It is more preferred that both formulae of $0.14 \leqq L_1/\lambda_0$ and $0.14 \leqq L_2/\lambda_0$ be satisfied. It is particularly preferred that both formulae of $0.18 \leqq L_1/\lambda_0$ and $0.18 \leqq L_2/\lambda_0$ be satisfied. It is preferred in terms of improved antenna gain that both formulae of $L_1/\lambda_0 \leqq 0.60$ and $L_2/\lambda_0 \leqq 0.60$ be satisfied. It is more preferred that both formulae of $L_1/\lambda_0 \leqq 0.50$ and $L_2/\lambda_0 \leqq 0.50$ be satisfied.

Figure 16:
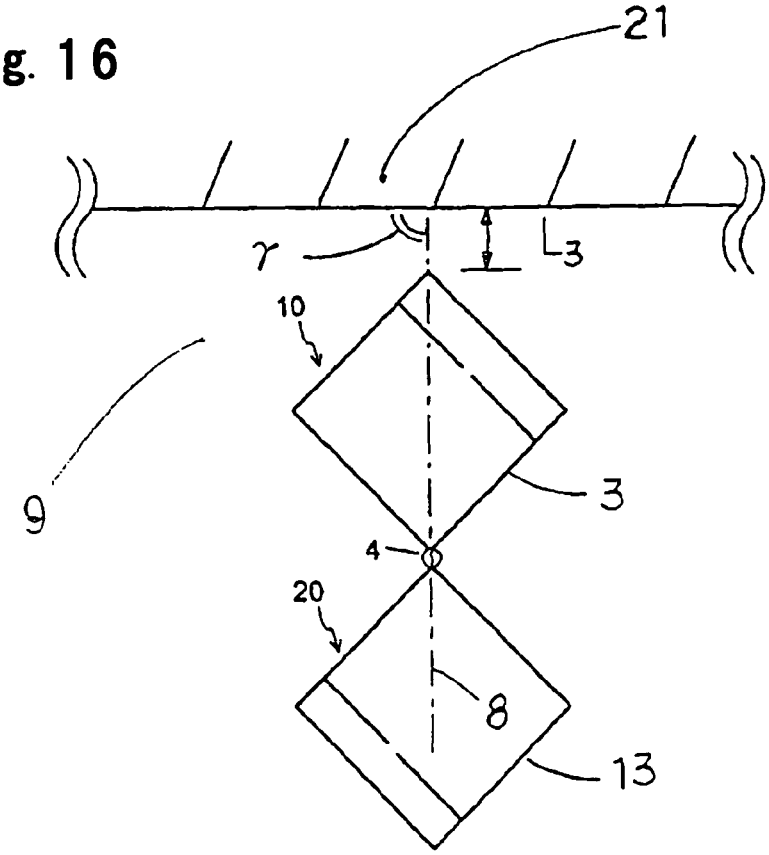
FIG. 16 is a plan view showing a case wherein the planar antenna shown in FIG. 1 is disposed in a region in the vicinity of the vehicle opening edge for the window glass sheet, and wherein an angle included between a transverse line and the vehicle opening edge is set at γ.
Figure 18:
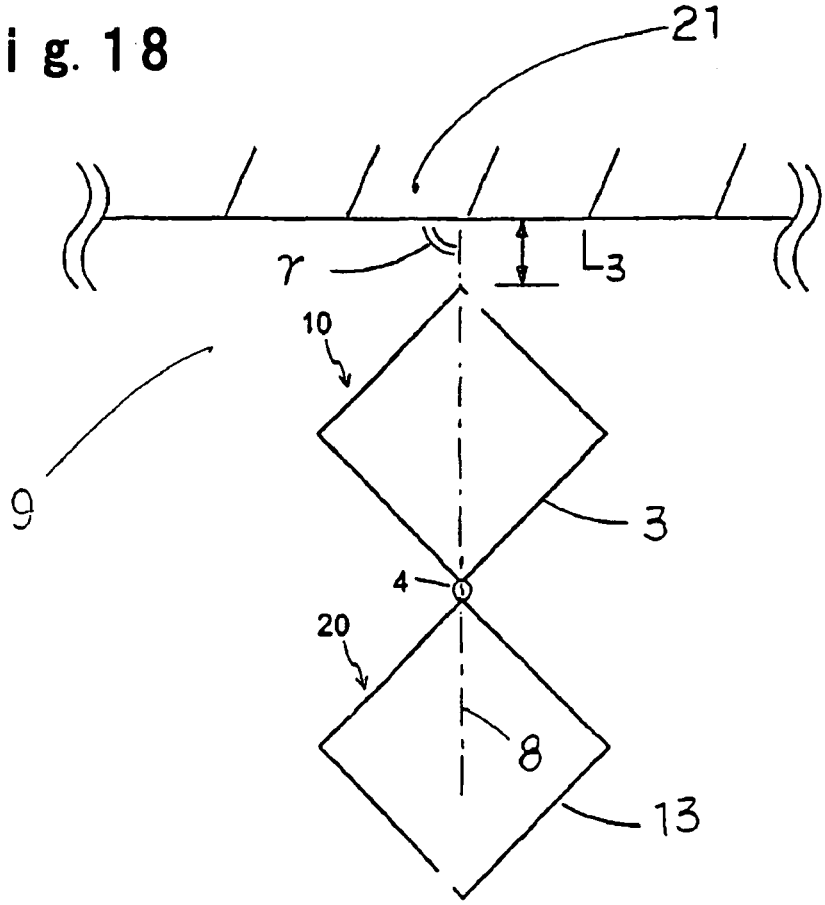
FIG. 18 is a plan view showing a case wherein the planar antenna shown in FIG. 17 is disposed in a region in the vicinity of the vehicle opening edge for the window glass sheet, and wherein an angle included between the transverse line and the vehicle opening edge is set at γ.

FIG. 16 shows a case wherein the planar antenna shown in FIG. 1 is disposed in a region in the vicinity of the vehicle opening edge 21 for the window glass sheet 9, and wherein the angle included between the transverse line 8 and the vehicle opening edge 21 is set at y. FIG. 18 shows a case wherein the planar antenna shown in FIG. 17 is disposed in region in the vicinity of the vehicle opening edge 21 for the window glass sheet 9, and wherein the angle included between a transverse line 8 and the vehicle opening edge 21 is set at $\gamma$. The transverse line 8 in FIG. 18 is an imaginary line, which connects between the center of gravity of the first antenna conductor 3 and the center of gravity of the second antenna conductor 13.

In each of FIGS. 16 and 18, reference $L_3$ designates the shortest distance between the planar antenna and the vehicle opening edge 21. It is preferred in terms of improved antenna gain that a formula of $0.04 \leqq L_3/\lambda_0$ be satisfied. It is more preferred that a formula of $0.10 \leqq L_3/\lambda_0$ be satisfied. It is particularly preferred that a formula of $0.18 \leqq L_3/\lambda_0$ be satisfied. It is preferred in terms of improved antenna gain that a formula of $L_3/\lambda_0 \leqq 0.50$, in particular, a formula of $L_3/\lambda_0 \leqq 0.40$, be satisfied. The angle $\gamma$ preferably ranges from 45 to 135 deg, more preferably from 60 to 120 deg and particularly preferably from 80 to 100 deg.

In FIGS. 15, 16, 17 and 18, it is preferred in terms of ensuring required view that the shortest distance between the vehicle opening edge 21 and a portion of the planar antenna according to the present invention farthest from the vehicle opening edge 21 be not longer than 200 mm. The shortest distance is preferably 150 mm, particularly preferably 100 mm. The direction for a radio wave to come in each of FIGS. 15, 16, 17 and 18 is the same as the direction shown in FIG. 11.

In the present invention, as shown in FIG. 25, a passive element 40 (indicated by solid lines and dotted lines) may be disposed on a surface of the dielectric substrate 9, which has the first antenna conductor 3 and the second antenna conductor 13, and at least one portion of the surface around the first antenna conductor 3 and the second antenna conductor 13. The passive element 40 has a function to avoid interference with antennas other than the antenna according to the present invention. It is preferred that the passive element 40 be disposed so as to surround the entire periphery of the first antenna conductor 3 and the second antenna conductor 13 as indicated by the solid lines and the dotted lines shown in FIG. 25, wherein the passive element indicated by the dotted line and the solid lines is a continuous conductor. However, the present invention is not limited to this arrangement. The planar antenna according to the present invention is usable even when the passive elements are disposed so as to partly surround the periphery of the first antenna conductor 3 and the second antenna conductor 13 as indicated by the solid lines in FIG. 25.

Figure 26:
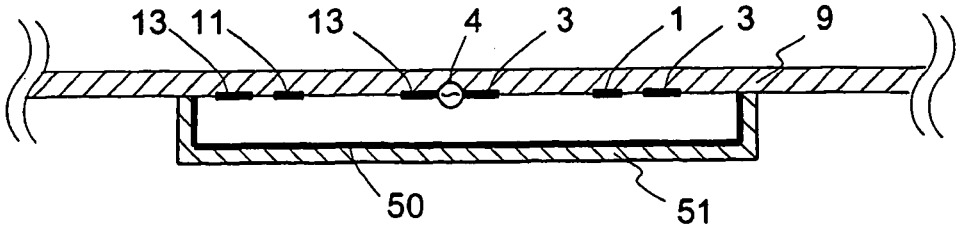
FIG. 26 is a cross-sectional view showing an embodiment, wherein a reflector is provided in the embodiment shown in FIG. 1.

FIG. 26 shows an embodiment, wherein a radio wave reflecting means is applied to the present invention. FIG. 26 is a case wherein the radio wave reflecting means is applied to the embodiment shown in FIG. 1, and FIG. 26 is a cross-sectional view of the window glass sheet vertically cut at a line, which includes the transverse line 8 shown in FIG. 1 and extensions of the transverse line 8. In FIG. 26, reference numeral 50 designates a conductive film as the radio wave reflecting means, and reference numeral 51 designates a casing made of an insulating material.

In the embodiment shown in FIG. 26, the dielectric substrate 9 comprises a window glass sheet for a vehicle, which has the casing 51 mounted onto an interior side so as to cover the first antenna conductor 3 and the second antenna conductor 13. The casing 51 has a bottom (an upper portion in this figure) formed with an open portion, and the casing 51 is mounted on the window glass sheet so as to have the open portion confronting the first antenna conductor 3 and the second antenna conductor 13. The casing 51 has the conductive film formed on an inner surface thereof. A portion of the conductive film, which is formed on the top (an lower portion in this figure) of the casing 51, is parallel or substantially parallel with the first antenna conductor 3 and the second antenna conductor 13, which is preferred. The case wherein the radio wave reflecting means is applied to the present invention is not limited to this embodiment. For example, the casing 51 per se may be made of metal. In this way, the radio wave reflecting means is provided on the interior side in the vicinity of the first antenna conductor and the second antenna conductor. An example of a power feeding means is that the central conductor of a coaxial cable (not shown) is connected to one of the first feeding point 4*a* and the second feeding point 4*b* by, e.g., soldering, and the outer conductor of the coaxial cable is connected to the other feeding point by, e.g., soldering.

However, the present invention is not limited to this arrangement. The first power feeding point 4*a* and the second power feeding point 4*b* may be, respectively, connected to lead wires, power feeding pins or the like by, e.g., soldering, and the respective lead wires, power feeding pins or the like may be connected to the central conductor and the outer conductor of the coaxial cable.

When the planar antenna according to the present invention is directly connected to a coaxial cable, lead wires, power feeding pins or the like, it is preferred that the feeding points be formed making the line width of the first feeding point 4*a* wider than the line width of the first antenna conductor 3 and/or by making the line width of the second feeding point 4*b* wider than the line width of the second antenna conductor 13. This is effective to improve the reliability of connection.

Another example of the power feeding means is that the first power feeding point 4*a* is connected to a power feeding line 7, the second power feeding point 4*b* is connected to a power feeding line 17, the central conductor of a coaxial cable is connected to one of the power feeding lines 7 and 17 by, e.g., soldering, and the outer conductor of the coaxial cable is connected to the other power feeding line by, e.g., soldering as shown in FIG. 8.

The power feeding lines 7 and 17 as shown in FIG. 8 may have feeding points provided thereon, the feeding points, which are connected to a coaxial cable, lead wires, power feeding pins or the like by, e.g., soldering, or make use of electromagnetic coupling, may be employed. The present invention is not limited to such arrangements. Any power feeding means is applicable as long as it is possible to feed power.

In the present invention, conductor patterns, such as the first antenna conductor 3, the second antenna conductor 13, the first capacitive coupling conductors, the second capacitive coupling conductors and the power feeding lines 7 and 17, may be normally fabricated by forming conductive patterns on the dielectric substrate 9, such as a circuit board. When the planar antenna according to the present invention is employed as a glass antenna for a vehicle, the dielectric substrate 9 is used as a window glass sheet, and the first antenna conductor 3, the second antenna conductor 13, the first capacitive coupling conductors and the second capacitive coupling conductors are normally formed by e.g. printing paste containing conductive metal, such as silver paste, on an interior surface of the window glass sheet and baking the paste. However, the present invention is not limited to this forming method. Linear members or foil-like members, which are made of a conductive substance, such as copper, may be formed on an interior surface or an exterior surface of the window glass sheet or in the window glass sheet per se.

EXAMPLE

Although the present invention will be described in reference to Examples, the present invention is not limited to these examples. Various variations or modifications are included in the present invention as long as the variations or the modifications do not depart from the spirit of the invention. Now, the Examples will be described in detail, referring to the accompanying drawings.

Example 1

Figure 10:
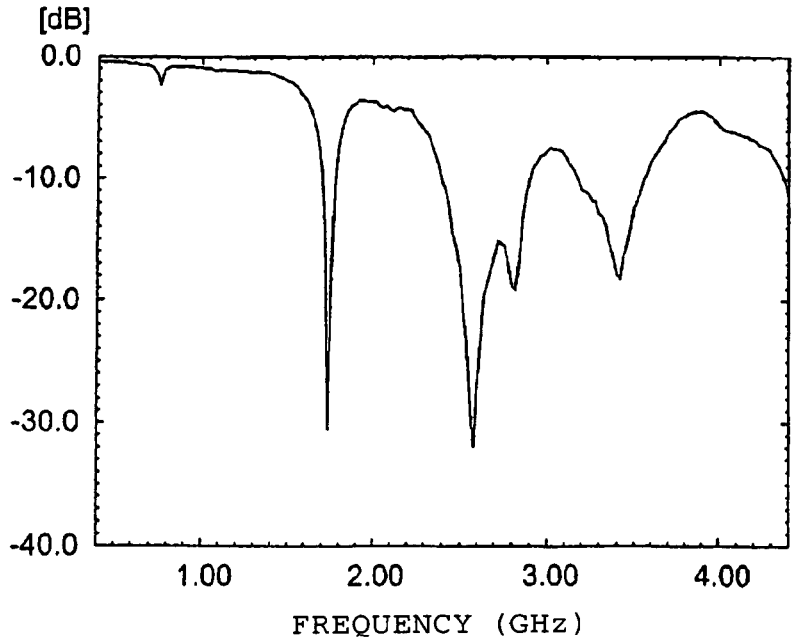
FIG. 10 is a diagram of a characteristic curve of frequencies to return loss (dB) in an Example 1.

A planar antenna as shown in FIG. 1 was fabricated on a glass substrate, and the planar antenna was measured. The operating frequency was 2.33 GHz, and the data shown in FIGS. 12, 13 and 14 stated later were measured at this operating frequency. The dimensions of each element, and the constants were listed below. The characteristics of return loss (dB) with respect to frequencies are shown in FIG. 10.

| | |
|---|---|
| Glass substrate | 200 × 100 × 3.5 mm |
| $L_a$ | 13.50 mm |
| $L_X$ | 16.88 mm |
| $L_Y$ | 16.88 mm |
| g | 0.50 mm |
| α | 45° |
| β | 45° |
| Line width of first antenna conductor 3, line width of second antenna conductor 13, line width of first capacitive coupling conductors and line width of second capacitive coupling conductors | 0.4 mm |

Figure 11:
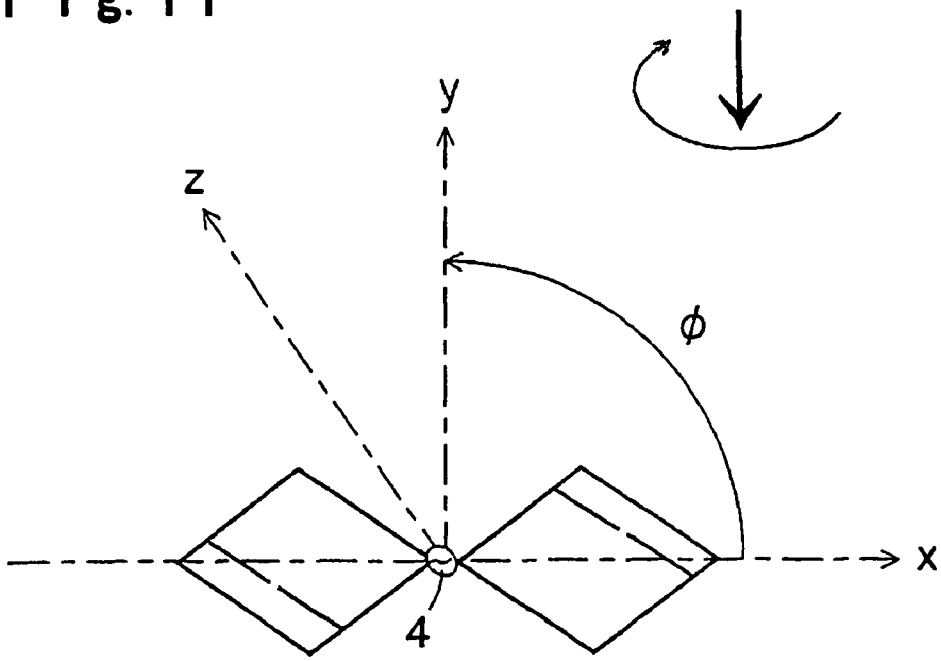
FIG. 11 is a schematic view in a case wherein the planar antenna shown in FIG. 1 is disposed on the x-z coordinate plane in an x, y and z coordinate.
Figure 13:
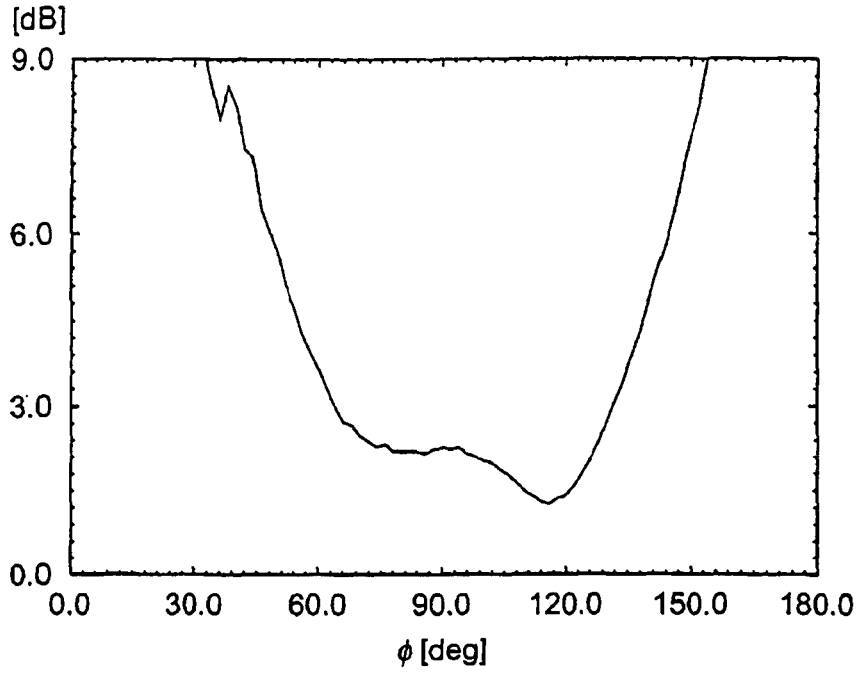
FIG. 13 is a diagram of a characteristic curve of axial ratios (dB) with respect to angles Φ in the Example.

FIG. 11 is a schematic view in a case wherein the planar antenna shown in FIG. 1 is disposed on the x-z coordinate plane in an x, y and z coordinate. On the assumption that the glass substrate as the dielectric substrate 9 is a window glass sheet for an automobile, when the case shown in FIG. 1 is seen from an interior side, the case shown in 11 is seen from an exterior side. In FIG. 11, the center of the power feeding point 4 accords with the intersection of the x axis, the y axis and the z axis, and the transverse line 8 overlaps with the x axis. The y axis is perpendicular to the glass substrate, and the z axis exists on the glass substrate. The angle Φ used in the measurements shown in FIGS. 11 and 13 is an angle included between the progress direction of a radio wave and the x axis, and the progress direction of the radio wave is parallel with the plane defined by the x axis and y axis. When the planar antenna shown in FIG. 1 serves as a receiving antenna, an incoming radio wave normally progresses in the direction indicated by an arrow in FIG. 11.

Figure 12:
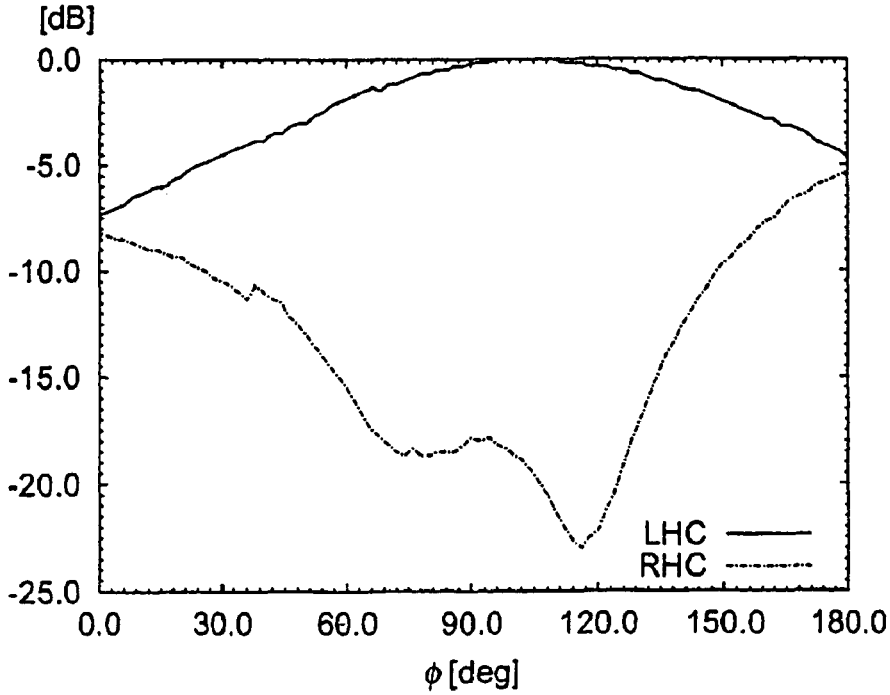
FIG. 12 is a diagram of characteristic curves of antenna gains with respect to angles Φ in the Example.

When a circular polarized wave (having a rotational direction indicated by a curved arrow in FIG. 11) was radiated from a radiator for measurement different from the radiator for the planar antenna shown in FIG. 1, antenna gains were measured with the angle Φ being modified. Antenna gains with respect to angles Φ are shown in FIG. 12, wherein the maximum antenna gain was defined 0 dB. In FIG. 11, the circularly polarized wave was counterclockwise rotated when viewing the incoming direction of the radio wave from the power feeding point 4.

Figure 14:
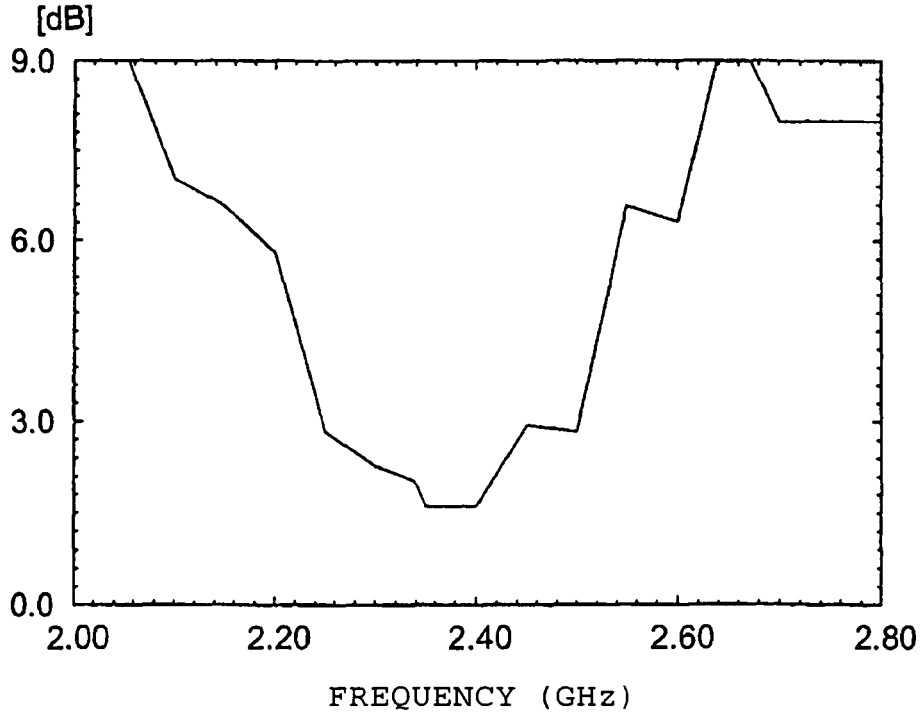
FIG. 14 is a diagram of a characteristic curve of frequencies to axial radios (dB) when the angle Φ is set at 90 deg.

In FIG. 12, LHC indicates characteristics of a left-handed circularly polarized wave, and RHC indicates characteristics of a right-handed circularly polarized wave. This is also applicable to similar characteristic curves stated later. The maximum value of LHC is set at 0 dB. Measured characteristics of axial ratio (dB) with respect to angles Φ and are shown in FIG. 13. Measured characteristics of axial ratios (dB) with respect to frequencies, which were measured when the angle Φ was 90 deg, are shown in FIG. 14.

Example 2

Figure 19:
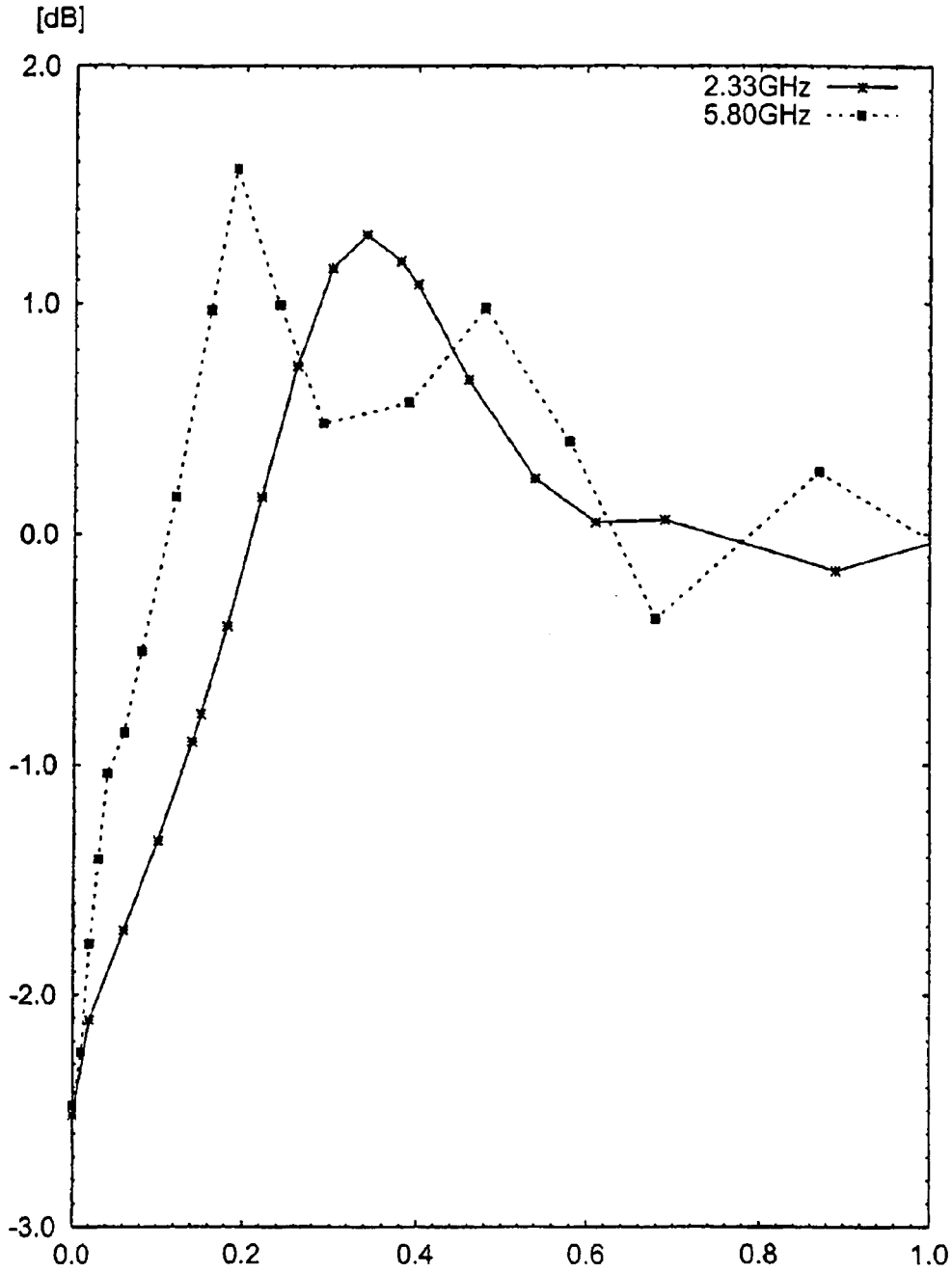
FIG. 19 is a diagram of characteristics curves in Example 1, wherein the horizontal axis represents $L_1/\lambda_0$, and the vertical axis represents antenna gains.

On the assumption that a planar antenna as shown in FIG. 1 was disposed on a glass substrate as shown in FIG. 15, numerical calculation was performed at an operating frequency of 2.33 GHz in accordance with the FDTD (Finite Difference Time Domain) method. On the assumption that the thickness of the glass substrate, the dimensions of respective elements of the planar antenna, and the constants (hereinbelow just referred as to the specifications in some cases) were the same as those in Example 1, and that the size of the glass substrate and the size of the car body were infinite, the numerical calculation was performed. Measured characteristics, wherein a formula of $L_1=L_2$ is satisfied, the horizontal axis represents $L_1/\lambda_0$ and the vertical axis represents antenna gains, are indicated by a solid line in FIG. 19.

Example 3

Figure 20:
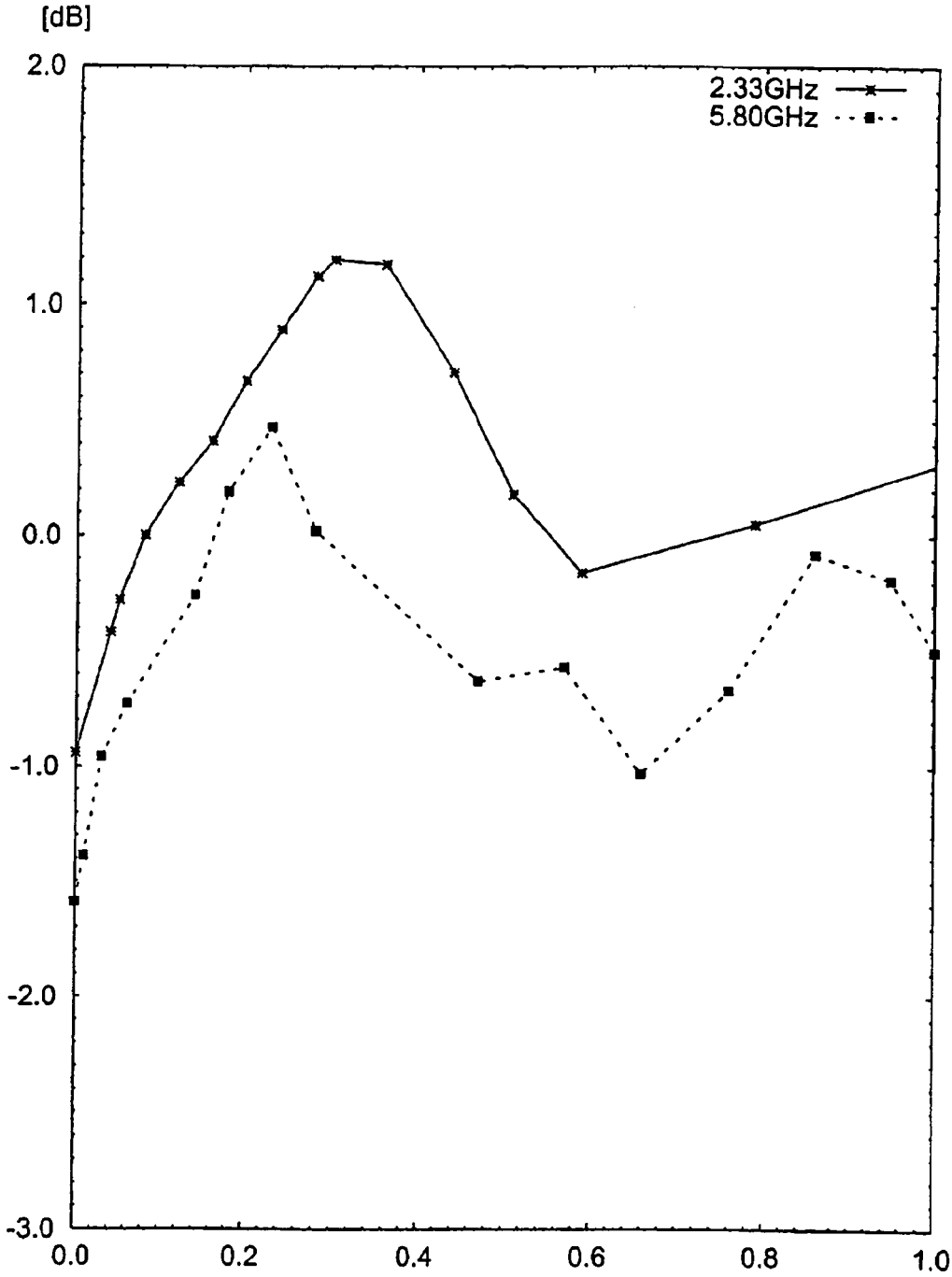
FIG. 20 is a diagram of characteristics curves in Example 2, wherein the horizontal axis represents $L_1/\lambda_0$, and the vertical axis represents antenna gains.
Figure 21:
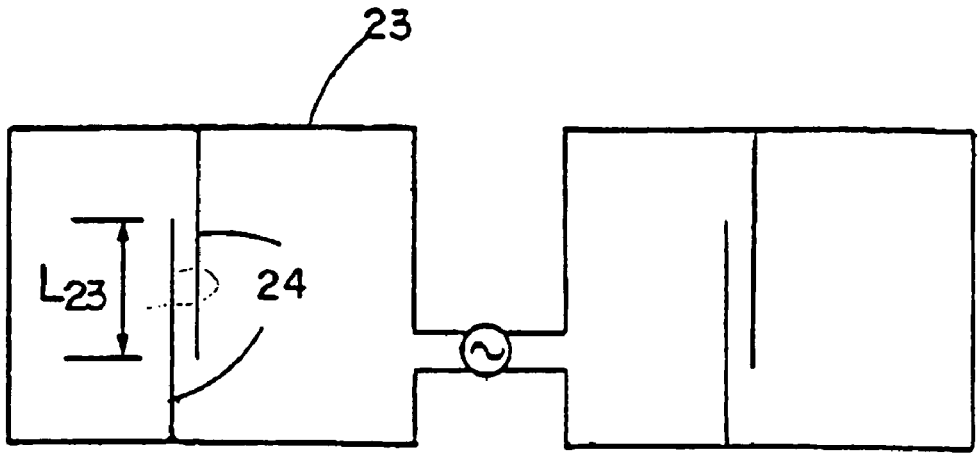
FIG. 21 is a plan view of a conventional planar antenna.

On the assumption that a planar antenna as shown in FIG. 1 was disposed on a glass substrate as shown in FIG. 16, numerical calculation was performed at an operating frequency of 2.33 GHz in accordance with the FDTD method. On the assumption that the thickness of the glass substrate and the specifications of the planar antenna were the same as those in Example 1, that γ was set at 90 deg, and that the size of the glass substrate and the size of the car body were infinite, the numerical calculation was performed. Measured characteristics, wherein the horizontal axis represents $L_3/\lambda_0$, and the vertical axis represents antenna gains, are indicated by a solid line in FIG. 20.

Example 4

On the assumption that a planar antenna as shown in FIG. 1 was formed on a glass substrate as shown in FIG. 15, numerical calculation was performed at an operating frequency of 5.80 GHz in accordance with the FDTD method. On the assumption that the thickness of the glass substrate and the specifications of the planar antenna were set below, and that the size of the glass substrate and the size of the car body were infinite, the numerical calculation was performed. Characteristics, wherein the formula of $L_1=L_2$ is satisfied, the horizontal axis represents $L_1/\lambda_0$ and the vertical axis represents antenna gains, are indicated by a dotted line in FIG. 19.

| | |
|---|---|
| Thickness of glass substrate | 3.5 mm |
| $L_a$ | 5.59 mm |
| $L_X$ | 6.98 mm |
| $L_Y$ | 6.98 mm |
| g | 0.50 mm |
| α | 45° |
| β | 45° |
| Line width of first antenna conductor 3, line width of second antenna conductor 13, line width of first capacitive coupling conductors and line width of second capacitive coupling conductors | 0.4 mm |

Example 5

On the assumption that a planar antenna as shown in FIG. 1 was formed on a glass substrate as shown in FIG. 16, numerical calculation was performed at an operating frequency of 5.80 GHz in accordance with the FDTD method. On the assumption that the thickness of the glass substrate and the specifications of the planar antenna were the same as those in Example 3, that y was set at 90 deg, and that the size of the glass substrate and the size of the car body were infinite, the numerical calculation was performed. Measured characteristics are indicated by a dotted line in FIG. 20, wherein the horizontal axis represents $L_3/\lambda_0$, and the vertical axis represents antenna gains.

Example 6

A high frequency glass antenna for an automobile was fabricated so as to have the same specifications as Example 1 except for La and except that the size of the glass substrate was infinite. Measurement were made at operating frequencies in the vicinity of 2.33 GHz, modifying La. Measured characteristics are shown in FIG. 27, wherein the horizontal axis represents $L_a/L_X$, and the vertical axis represents axial ratios. Numerical calculation was performed at operating frequencies of from 2.28 to 2.52 GHz in accordance with the FDTD method. Values which were obtained when the axial ratio at the same point on the horizontal axis became minimum are selected, and the selected values are shown in FIG. 27.

Example 7

Figure 28:
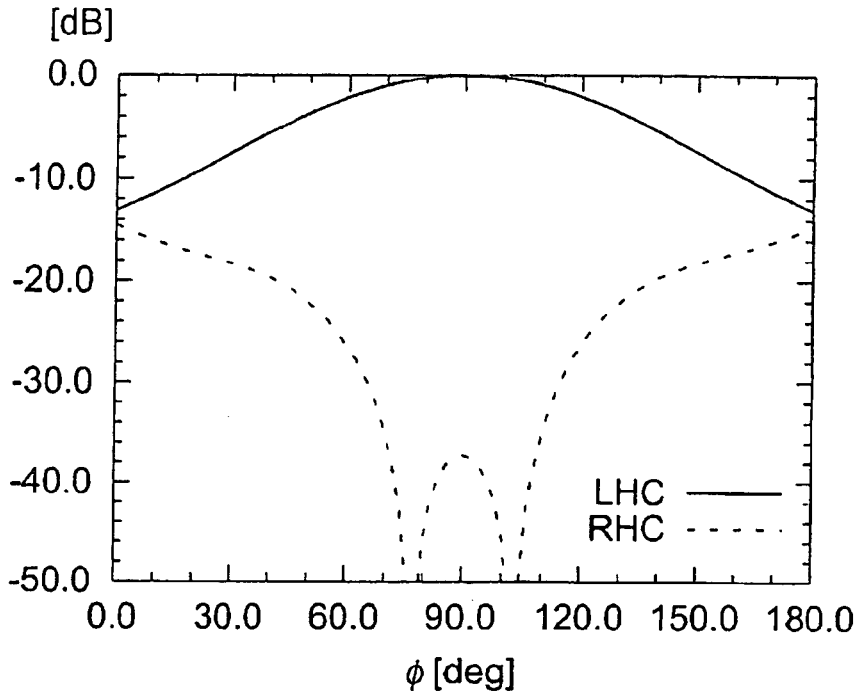
FIG. 28 is a diagram of characteristic curves of antenna gains with respect to angles Φ in the Example 7.
Figure 29:
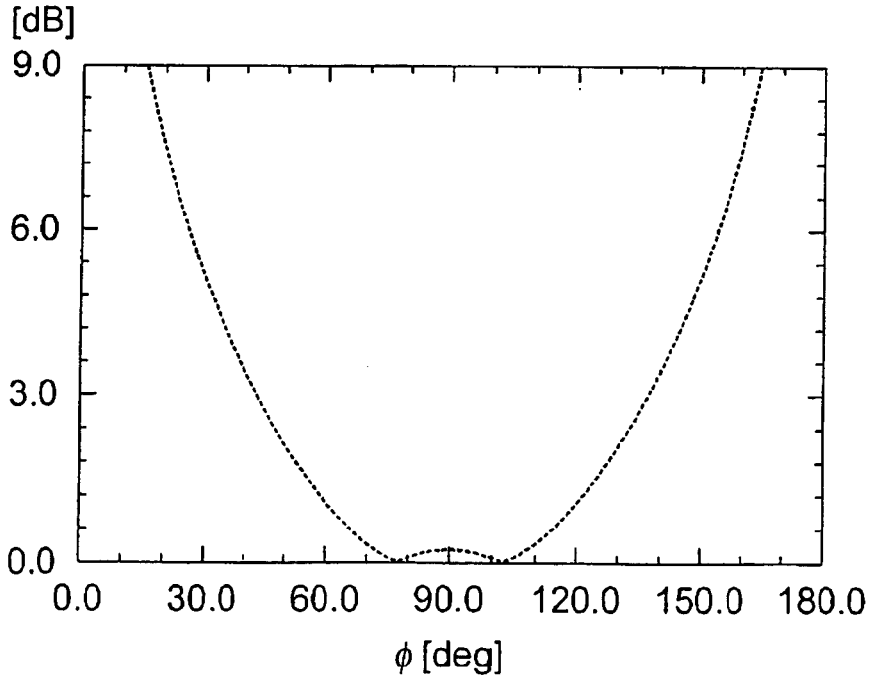
FIG. 29 is a diagram of a characteristic curve of axial ratios (dB) with respect to angles Φ in the Example 7.

On the assumption that a planar antenna as shown in FIG. 22 was formed on a glass substrate, numerical calculation was performed at an operating frequency of 2.40 GHz in accordance with the FDTD method. FIG. 28 and FIG. 29, which may be explained later, show results, which were calculated at this operating frequency. On the assumption that the size of the glass substrate was infinite, the specifications of the planar antenna were set below.

| | |
|---|---|
| Thickness of glass substrate | 3.5 mm |
| Relative dielectric constant of glass substrate | 7.0 |
| $L_X$, $L_Y$ | 26.33 mm |
| $L_{b1}$, $L_{b2}$ | 17.93 mm |
| $L_{b3}$, $L_{b4}$ | 16.0 mm |
| $\beta_{b1}$, $\beta_{b2}$ | 135° |
| Line width of first antenna conductor 3, line width of second antenna conductor 13, line width of first branch line 24 and line width of second branch line 25 | 0.4 mm |

FIG. 23 shows a schematic view in a case wherein the planar antenna shown in FIG. 22 is disposed on the x-z coordinate plane in an x, y and z coordinate. On the assumption that the glass substrate as the dielectric substrate 9 is a window glass sheet for an automobile and that the case shown in FIG. 22 is viewed from an interior side, the case shown in FIG. 23 is seen from an exterior side. In FIG. 23, the center of the power feeding point 4 accords with the intersection of the x axis, the y axis and the z axis, and the transverse line 8 overlaps with the x axis. The y axis is perpendicular to the glass substrate, and the z axis exists on the glass substrate. The angle Φ used for calculation shown in FIG. 28 and FIG. 29 is an angle included between the progress direction of a radio wave and the x axis. The progress direction of the radio wave is parallel with the plane defined by the x axis and the y axis. When the planar antenna shown in FIG. 1 serves as a receiving antenna, an incoming radio wave normally progresses in the direction indicated by a linear arrow in FIG. 23.

On the assumption that a circularly polarized wave (having a rotational direction indicated by a curved arrow in FIG. 23) was radiated from a radiator different from the radiator for the planar antenna in this Example, antenna gains were calculated with the angle Φ being modified. The calculated antenna gains with respect to the angles Φ are shown in FIG. 28, wherein the maximum antenna gain is set at 0 dB. In FIG. 23, the circularly polarized wave is counterclockwise rotated when viewing the incoming direction of the radio wave from the power feeding point 4.

In FIG. 28, the maximum value of LHC is set at 0 dB. FIG. 29 shows characteristics of axial ratios (dB) with respect to angles Φ.

Example 8

On the assumption that a planar antenna as shown in FIG. 24 was disposed on a glass substrate, numerical calculation was performed at an operating frequency of 2.38 GHz in accordance with the FDTD method. The results shown in FIG. 30 and FIG. 31, which will be explained later, were obtained by calculation at this operating frequency. The specifications for the glass substrate was the same as Example 7, and the specifications of the planar antenna were below.

| | |
|---|---|
| $L_X$, $L_Y$ | 26.33 mm |
| $L_{c1}$, $L_{c2}$ | 14.00 mm |
| $\beta_{c1}$, $\beta_{c2}$ | 135° |
| Line width of first antenna conductor 3, line width of second antenna conductor 13, line width of first auxiliary line 26 and line width of second auxiliary line 27 | 0.4 mm |

Figure 30:
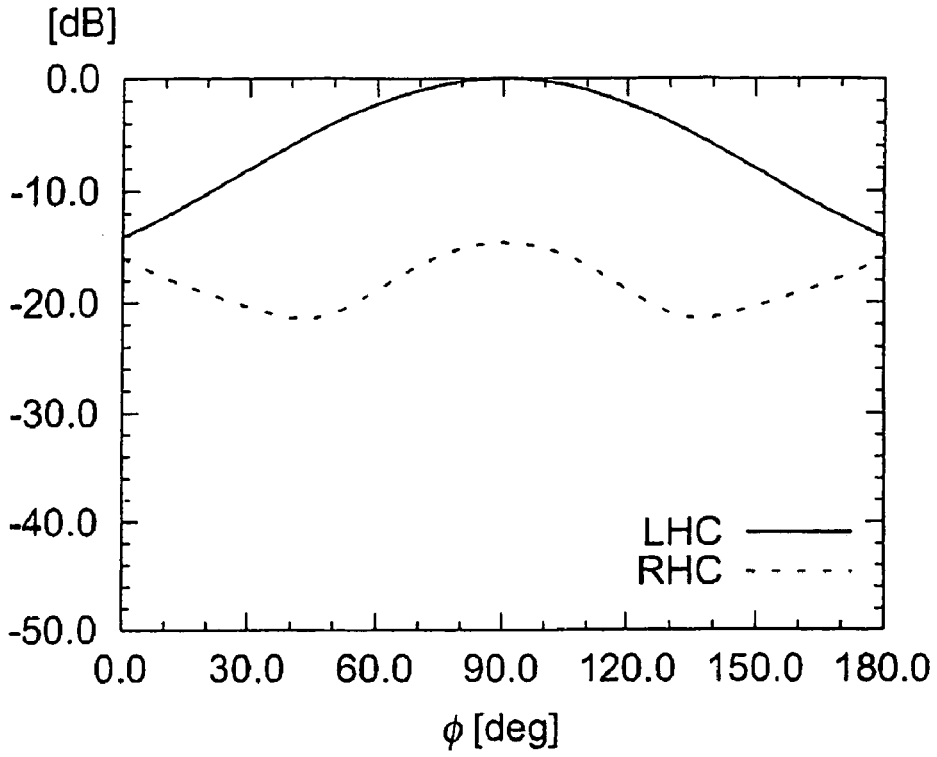
FIG. 30 is a diagram of characteristic curves of antenna gains with respect to angles Φ in the Example 8.
Figure 31:
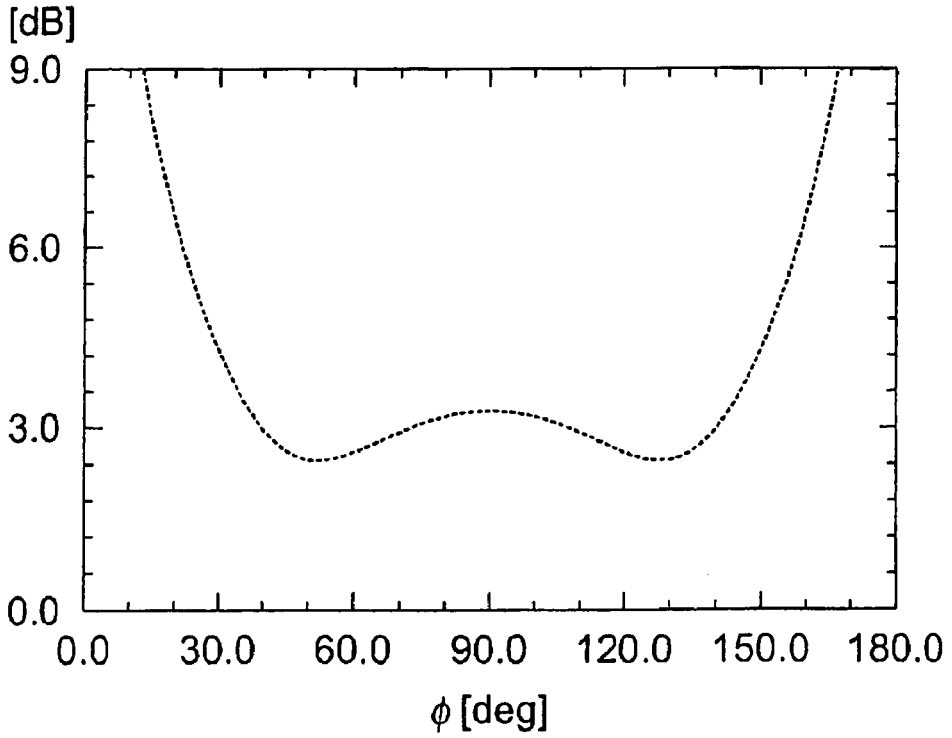
FIG. 31 is a diagram of a characteristic curve of axial ratios (dB) with respect to angles Φ in the Example 8.

FIG. 30 shows antenna gains with respect to angles Φ, which were obtained by calculation, wherein the maximum value LHC was set at 0 dB. FIG. 31 shows characteristics of axial ratios (dB) with respect to angles Φ. The calculation conditions of the data shown in FIG. 30 and FIG. 31 are the same as the calculation conditions for the data shown in FIG. 28 and FIG. 29 with respect to Example 7 under such conditions that the planar antenna of Example 7 was disposed so that the extending direction of the first auxiliary line 26 and the extending direction of the second auxiliary line 27 accorded with the extending direction of the first branch line 24 and the extending direction of the second branch line 25 shown in FIG. 23.

Example 9

On the assumption that a planar antenna as shown in FIG. 25 was disposed on a glass substrate, numerical calculation was performed at an operating frequency of 2.50 GHz in accordance with the FDTD method. The results shown in FIG. 32 and FIG. 33, which will be explained later, were obtained by calculation at this operating frequency. The specifications for the glass substrate was the same as Example 7, and the specifications of the planar antenna were below.

| | |
|---|---|
| $L_X$, $L_Y$ | 26.33 mm |
| $L_{c1}$, $L_{c2}$ | 16.00 mm |
| $\beta_{c1}$, $\beta_{c2}$ | 135° |
| Line width of first antenna conductor 3 and line width of second antenna conductor 13 | 0.4 mm |

Figure 32:
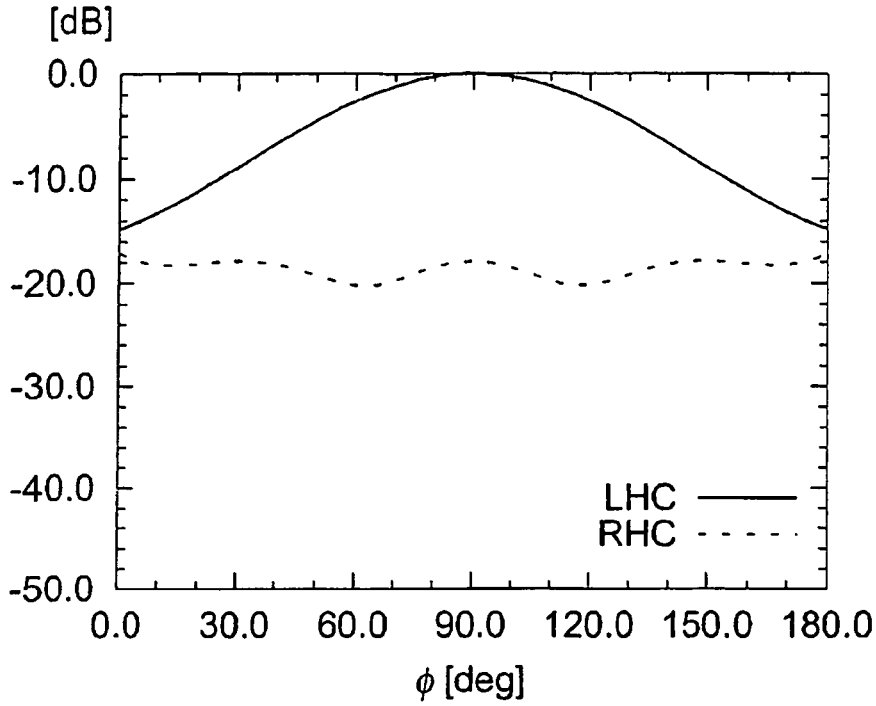
FIG. 32 is a diagram of characteristic curves of antenna gains with respect to angles Φ in the Example 9.
Figure 33:
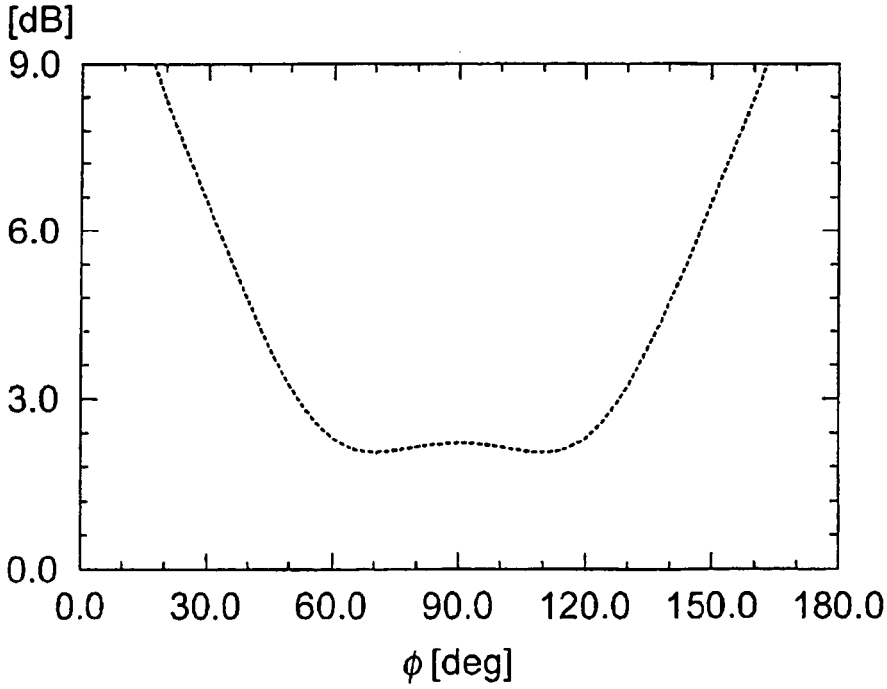
FIG. 33 is a diagram of a characteristic curve of axial ratios (dB) with respect to angles Φ in the Example 9.

FIG. 32 shows antenna gains with respect to angles Φ. In this figure, the maximum value of LHC was set at 0 dB. FIG. 33 shows characteristics of axial ratios (dB) with respect to angles Φ. The calculation conditions of the data shown in FIG. 32 and FIG. 33 are the same as the calculation conditions for the data shown in FIG. 28 and FIG. 29 with respect to Example 7 under such conditions that the planar antenna of Example 7 was provided so that the extending direction of the first auxiliary line 26 and the extending direction of the second auxiliary line 27 accorded with the extending direction of the first branch line 24 and the extending direction of the second branch line 25 shown in FIG. 23.

Example 10

On the assumption that a planar antenna as shown in FIG. 22 was disposed on a glass substrate, numerical calculation was performed at an operating frequency of 2.40 GHz in accordance with the FDTD method. The calculation was performed under such conditions that $L_{b1}$ and $L_{b2}$ were the same as each other, and that $L_{b1}$ and $L_{b2}$ were being modified. Characteristics of the planar antenna in this Example are shown in FIG. 34, wherein the horizontal axis represents $((L_{b1}$ or $L_{b2})/(2\times(L_X+L_y)))$ and the vertical axis represents axial ratios. The specifications of the glass substrate were the same as those in Example 7, and the specifications of the planar antenna were listed below.

| | |
|---|---|
| $L_X$, $L_Y$ | 26.33 mm |
| $L_{b3}$, $L_{b4}$ | 16.00 mm |
| $B_{b1}$, $\beta_{b2}$ | 135° |
| Line width of first antenna conductor 3, line width of second antenna conductor 13, line width of first branch line 24 and line width of second branch line 25 | 0.4 mm |

Example 11

On the assumption that a planar antenna as shown in FIG. 24 was formed on a glass substrate, numerical calculation was performed in accordance with the FDTD method. The specifications of the glass substrate were the same as those in Example 7, and the specifications of the planar antenna were listed below. The calculation was made under such conditions that $\beta_{c1}$ and $\beta_{c2}$ were set at the same value, and $\beta_{c1}$ and $\beta_{c2}$ were being modified. Characteristics of the planar antenna in this Example are shown in FIG. 35, wherein the horizontal axis represents $\beta_{c1}(\beta_{c2})$, and the vertical axis represents axial ratios. As $\beta_{c1}$ and $\beta_{c2}$ vary, $L_{c1}$ and $L_{c2}$ also vary. The angular range of from 90 to 180 deg in FIG. 35 corresponds to the rotational direction of the circularly polarized wave shown in FIG. 23. The angular range of from 0 to 90 deg in FIG. 35 corresponds to the opposite rotational direction of the rotational direction of the circularly polarized wave shown in FIG. 23.

| | |
|---|---|
| $L_X$, $L_Y$ | 26.33 mm |
| $L_{c1}$, $L_{c2}$ ($\beta_{c1}$, $\beta_{c2}$: 135°) | 13.165 mm |
| Line width of first antenna conductor 3, line width of second antenna conductor 13, line width of first auxiliary line 26 and line width of second auxiliary line 27 | 0.4 mm |

Example 12

Numerical calculation was performed with respect to a relationship between antenna gains and distances between the planar antenna shown in FIG. 22 and the vehicle opening edge 21 as shown in FIG. 15 in a case wherein a planar antenna shown in FIG. 22 instead of the planar antenna shown in FIG. 15, i.e., the planar antenna shown in FIG. 1, was disposed on the dielectric substrate 9 used as a window glass sheet as shown in FIG. 15.

Figure 36:
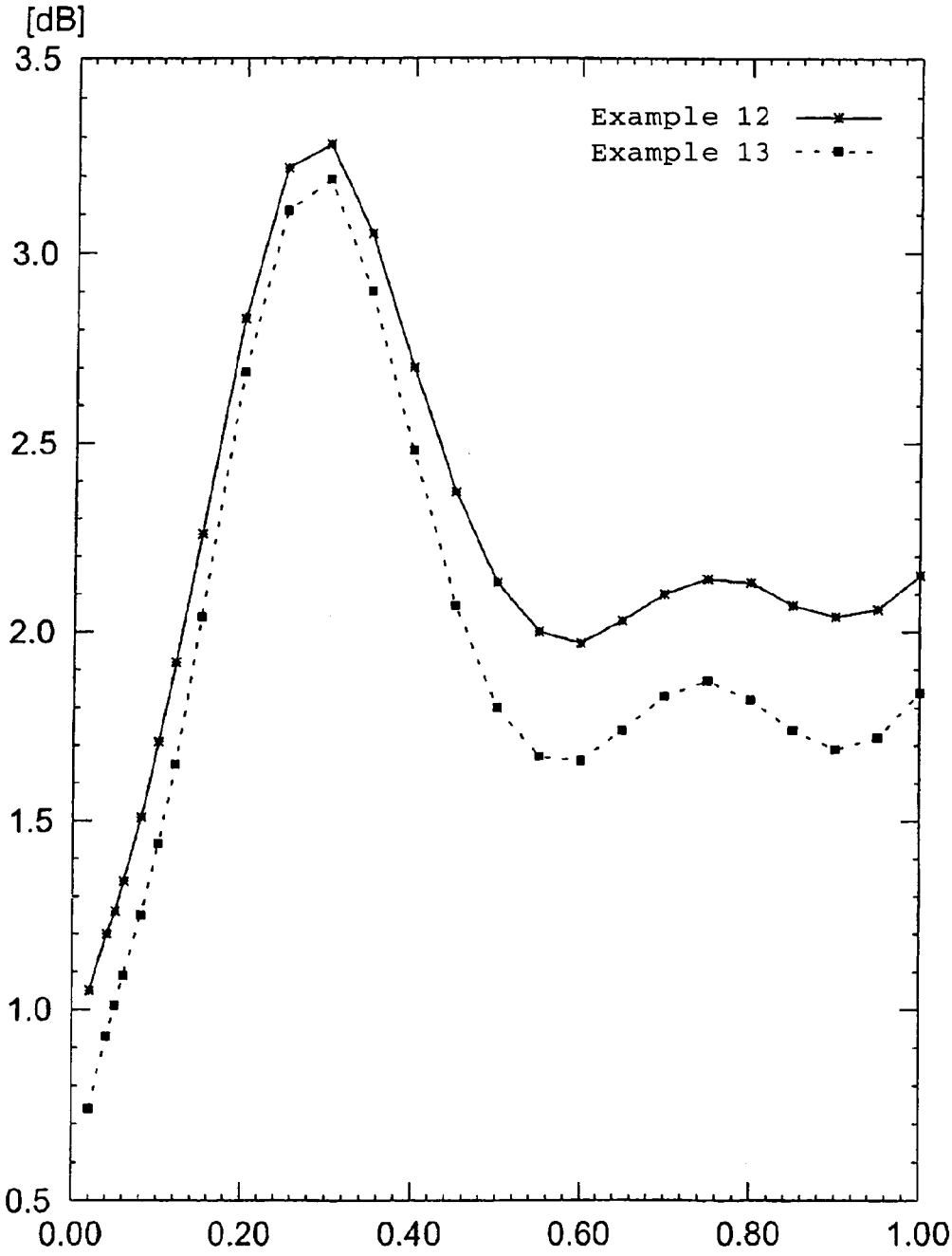
FIG. 36 is a diagram of characteristic curves in Example 12 and Example 13, wherein the horizontal axis represents $L_1/\lambda_0$, and the vertical axis represents antenna gains.

The numerical calculation was performed at an operating frequency of 2.40 GHz in accordance with the FDTD method. The specifications of the glass substrate were the same as those in Example 7, and the numerical calculation was performed in such a condition that the size of the car body was infinite. The formula of $L_1=L_2$ was satisfied. Characteristics of the planar antenna in this example are shown by a solid line in FIG. 36, wherein the horizontal axis represents $L_1/\lambda_0$, and the vertical axis represents antenna gains. The specifications of the planar antenna were listed below.

| | |
|---|---|
| $L_X$, $L_Y$ | 26.33 mm |
| $L_{b1}$, $L_{b2}$ | 18.33 mm |
| $L_{b3}$, $L_{b4}$ | 16.0 mm |
| $B_{b1}$, $\beta_{b2}$ | 135° |
| Line width of first antenna conductor 3, line width of second antenna conductor 13, line width of first branch line 24 and line width of second branch line 25 | 0.4 mm. |

Example 13

Numerical calculation was performed with respect to a relationship between antenna gains and distances between the planar antenna shown in FIG. 24 and the vehicle opening edge 21 as shown in FIG. 15 in a case wherein the planar antenna shown in FIG. 24 instead of the planar antenna shown in FIG. 15, i.e., the planar antenna shown in FIG. 1, was formed on a dielectric substrate 9 used as a window glass sheet as shown in FIG. 15.

The numerical calculation was performed at an operating frequency of 2.40 GHz in accordance with the FDTD method. The numerical calculation was performed on the assumption that the specifications of the glass substrate and the specifications of the planar antenna were the same as those in Example 8, and that the car body was infinite. The formula of $L_1=L_2$ was satisfied. Characteristics of the planar antenna in this example are shown by a dotted line in FIG. 36, wherein the horizontal axis represents $L_1/\lambda_0$, and the vertical axis represents antenna gains.

Example 14

Figure 37:
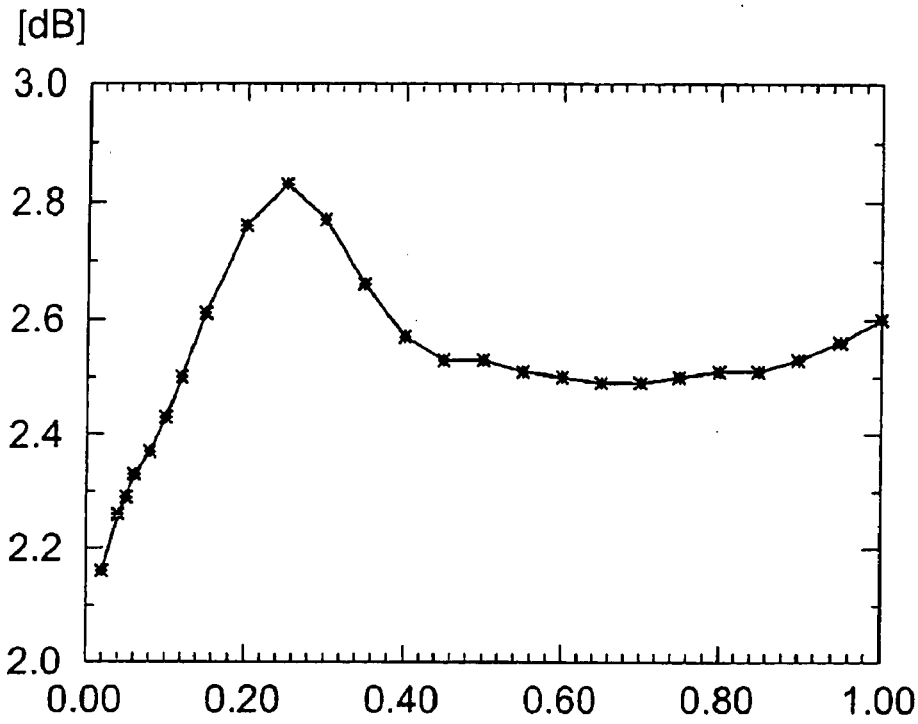
FIG. 37 is a diagram of a characteristic curve in Example 14, wherein the horizontal axis represents $L_3/\lambda_0$, and the vertical axis represents antenna gains.

In accordance with the FDTD method, numerical calculation was performed at an operation frequency of 2.40 GHz with respect to a relationship between antenna gains and distances between the planar antenna shown in FIG. 22 and the vehicle opening edge 21 as shown in FIG. 16 in a case wherein the planar antenna shown in FIG. 22 instead of the planar antenna shown in FIG. 16, i.e., the planar antenna shown in FIG. 1, was disposed on a dielectric substrate 9 used as a window glass sheet as shown in FIG. 16. The numerical calculation was performed on the assumption that the specifications of the glass substrate and the specifications of the planar antenna were the same as those in Example 12, that γ was set at 90 deg, and that the size of the car body was infinite. Characteristics of the planar antenna in this example are shown in FIG. 37, wherein the horizontal axis represents $L_3/\lambda_0$, and the vertical axis represents antenna gains.

Example 15

Figure 38:
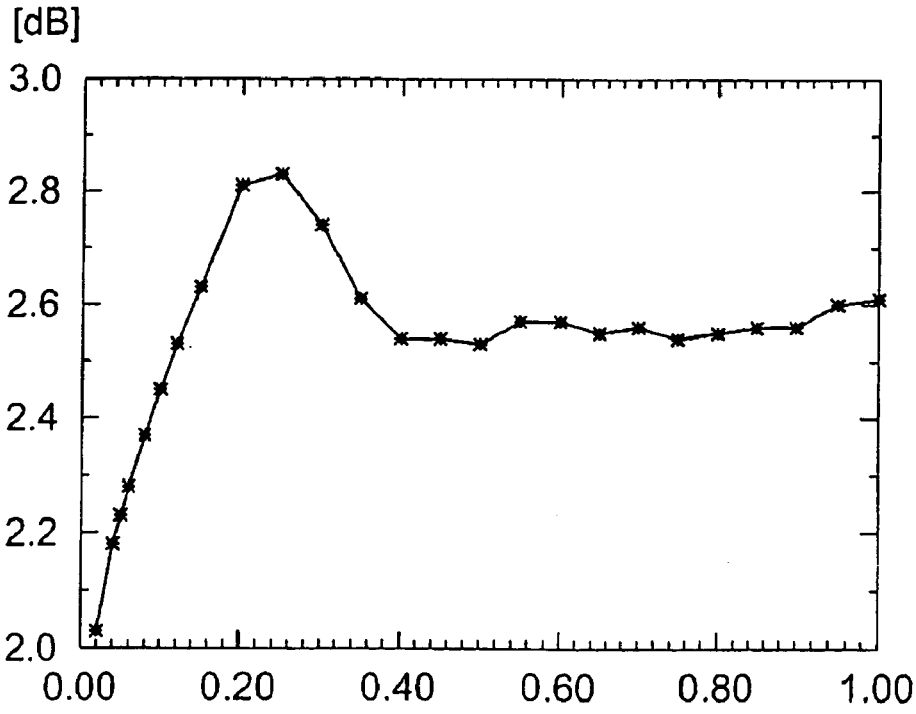
FIG. 38 is a diagram of a characteristic curve in Example 15, wherein the transverse axis represents $L_3/\lambda_0$, and the vertical axis represents antenna gains.

In accordance with the FDTD method, numerical calculation was performed at an operation frequency of 2.40 GHz with respect to a relationship between antenna gains and distances between the planar antenna shown in FIG. 24 and the vehicle opening edge 21 as shown in FIG. 16 in a case wherein the planar antenna shown in FIG. 24 instead of the planar antenna shown in FIG. 16, i.e., the planar antenna shown in FIG. 1, was disposed on a dielectric substrate 9 used as a window glass sheet as shown in FIG. 16. The numerical calculation was performed on the assumption that the specifications of the glass substrate and the specifications of the planar antenna were the same as those in Example 8, that γ was set at 90 deg, and that the size of the car body was infinite. Characteristics of the planar antenna in this example are shown in FIG. 38, wherein the horizontal axis represents $L_3/\lambda_0$, and the vertical axis represents antenna gains.

The embodiments shown in FIGS. 1 to 9 particularly contribute to make the planar antenna smaller. The embodiments shown in FIGS. 22 to 25 particularly contribute to improve an antenna gain.

The present invention is applicable to communication using, e.g., a circularly polarized wave, such as ETC, or SDARS (Satellite Digital Audio Radio System at about 2.6 GHz).

The entire disclosures of Japanese Patent Application No. 2003-411246 filed on Dec. 12, 2003 and Japanese Patent Application No. 2004-041634 filed on Feb. 18, 2004 including specifications, claims, drawings and summaries are incorporated herein by reference in their entireties.

What is claimed is:

1. A planar antenna comprising a dielectric substrate having a first antenna conductor in a loop shape and a second antenna conductor in a loop shape disposed so as to be adjacent to each other;

wherein there is disposed a first coupling conductor, the first coupling conductor comprising a pair of coupling branch lines connected to the first antenna conductor and extending inward from the first antenna conductor, and the coupling branch lines have open ends disposed so as to be adjacent to each other and to be capacitively coupled to each other;

wherein when the coupling branch lines are parallel with each other or are in alignment with each other, respective open ends of the coupling branch lines are positioned to be the closest portions of the coupling branch lines;

wherein there is disposed a second coupling conductor, the second coupling conductor comprising a pair of coupling branch lines connected to the second antenna conductor and extending inward from the second antenna conductor, and the coupling branch lines have open ends disposed so as to be adjacent to each other and to be capacitively coupled to each other;

wherein when the coupling branch lines are parallel with each other or in alignment with each other, both open ends of the coupling branch lines are closest portions with respect to each other; and wherein when the coupling branch lines are not parallel with each other, both open ends of the coupling branch lines or one of the open ends of the coupling branch lines is located in the vicinity of closest portions of the coupling branch lines.

2. The planar antenna according to claim 1, wherein when a shortest distance between the coupling branch lines of the first capacitive coupling conductors is g1, and a shortest distance between the coupling branch lines of the second capacitive coupling conductors is g2 in case wherein a formula of $\lambda g=\lambda 0 \cdot k$ is satisfied wherein a radio wave for communication has a wavelength of $\lambda 0$ in air, and the dielectric substrate is made of a material having a shortening coefficient of wavelength of k, the following formulae are satisfied:

$$g_1/\lambda_g \leqq 0.034,\ g_2/\lambda_g \leqq 0.034,\ g_1 \geqq 0.1 \text{ mm and } g_2 \geqq 0.1 \text{ mm.}$$

3. The planar antenna according to claim 1, wherein the coupling branch lines of the first capacitive coupling conductors are disposed in such a positional relationship that, provided that each of the coupling branch lines extends toward an open end side, extending portions of the coupling branch lines collide each other and are connected to each other; and wherein the coupling branch lines of the second capacitive coupling conductors are disposed in such a positional relationship that, provided that each of the coupling branch lines extends toward an open end side, extending portions of the coupling branch lines collide each other and are connected to each other.

4. The planar antenna according to claim 1, wherein the coupling branch lines of the first capacitive coupling conductors are in alignment or substantial alignment with each other; and wherein the coupling branch lines of the second capacitive coupling conductors are in alignment or substantial alignment with each other.

5. The planar antenna according to claim 1, wherein when the first antenna conductor and the coupling branch lines of the first capacitive coupling conductors are called a first loop element, when the second antenna conductor and the coupling branch lines of the second capacitive coupling conductors are called a second loop element, and when an imaginary line connecting between a center of gravity of the first antenna conductor and a center of gravity of the second antenna conductor is called a transverse line;

the first antenna conductor has a first feeding point formed thereon, and the second antenna conductor has a second feeding point formed thereon; and the second loop element is disposed so as to be symmetrical or substantially symmetrical with the first loop element about a central point between the first feeding point and the second feeding point or a central point of the transverse line.

6. The planar antenna according to claim 5, wherein the first antenna conductor and the second antenna conductor are disposed so that the center of gravity of the first antenna conductor, the first feeding point, the second feeding point and the center of gravity of the second antenna conductor are in alignment or substantial alignment with one another.

7. The planar antenna according to claim 5, wherein a shape defined by the first antenna conductor is symmetrical or substantially symmetrical with respect to a first straight line as a symmetry axis; and a shape defined by the second antenna conductor is symmetrical or substantially symmetrical with respect to a second straight line as a symmetry axis;

wherein an imaginary line connecting between the center of gravity of the first antenna conductor and the center of gravity of the second antenna conductor is called the transverse line, an angle included between the first straight line and the transverse line and an angle included between the second straight line and the transverse line are from 30 to 60 deg, respectively; and the first straight line and the second straight line are parallel or substantially parallel with each other.

8. The planar antenna according to claim 7, wherein when the first antenna conductor and the coupling branch lines of the first capacitive coupling conductors are connected at two junction portions, which are called first junction portions; and when the second antenna conductor and the coupling branch lines of the second capacitive coupling conductors are connected at two junction portions, which are called second junction portions;

the respective first junction portions are disposed on the same side as each other with respect to the first straight line, and the respective second junction portions are disposed on the same side as each other with respect to the second straight line.

9. The planar antenna according to claim 7, wherein the first junction portions are disposed at location except for the first straight line, and the second junction portions are disposed at locations except for the second straight line.

10. The planar antenna according to claim 1, wherein when each of the shape defined by the first antenna conductor and the shape defined by the second antenna conductor is a polygon or substantial polygon, the first antenna conductor has the first feeding point disposed at or in the vicinity of a vertex, and the second antenna conductor has the first feeding point disposed at or in the vicinity of a vertex.

11. The planar antenna according to claim 1, wherein when each of the shape defined by the first antenna conductor and the shape defined by the second antenna conductor is a quadrangle or substantial quadrangle.

12. The planar antenna according to claim 1, wherein each of the shape defined by the first antenna conductor and the shape defined by the second antenna conductor is a square or substantial square.

13. The planar antenna according to claim 1, wherein the coupling branch lines of the first capacitive coupling conductors are in alignment or substantial alignment with each other, and the coupling branch lines of the second capacitive coupling conductors are in alignment or substantial alignment with each other;

wherein when an imaginary line connecting between a center of gravity of the first antenna conductor and a center of gravity of the second antenna conductor is called a transverse line, an angle included between a first capacitive conductor and the transverse line is from 30 to 60 deg in a case wherein the transverse line is clockwise viewed from the first capacitive conductor in a viewing direction, which is a direction for a radio wave to come or a radio wave to be radiated from the planar antenna, and wherein an electric field generated by a circularly polarized wave of the radio wave is counterclockwise rotated in the viewing direction; and an angle included between a second capacitive conductor and the transverse line is from 30 to 60 deg in a case wherein the transverse line is clockwise viewed from the second capacitive conductor in the viewing direction.

14. The planar antenna according to claim 1, wherein the coupling branch lines of the first capacitive coupling conductors are in alignment or substantial alignment with each other, and the coupling branch lines of the second capacitive coupling conductors are in alignment or substantial alignment with each other;

wherein when an imaginary line connecting between a center of gravity of the first antenna conductor and a center of gravity of the second antenna conductor is called a transverse line, an angle included between a first capacitive conductor and the transverse line is from 120 to 150 deg in a case wherein the transverse line is clockwise viewed from the first capacitive conductor in a viewing direction, which is a direction for a radio wave to come or a radio wave to be radiated from the planar antenna, and wherein an electric field generated by a circularly polarized wave of the radio wave is clockwise rotated in the viewing direction; and an angle included between a second capacitive conductor and the transverse line is from 120 to 150 deg in a case wherein the transverse line is clockwise viewed from the second capacitive conductor in the viewing direction.

15. The planar antenna according to claim 1, wherein in a case wherein a shape defined by the first antenna conductor is a polygon or substantial polygon having a larger even number of vertexes than a triangle, and a shape defined by the second antenna conductor is a polygon or substantial polygon having a larger even number of vertexes than a triangle;

when an angle of the first antenna conductor with a feeding point disposed thereat is called a first power feeding angle;

when a diagonal, which connects between a vertex having the first power feeding angle and a vertex having an opposite angle closest to a straight line connecting between a center of gravity of the shape defined by the first antenna conductor and the vertex having the first power feeding angle among opposite angles of the first power feeding angle, is called a first diagonal;

when an angle of the second antenna conductor with a feeding point disposed thereat is called a second power feeding angle; and when a diagonal, which connects between a vertex having the second power feeding angle and a vertex having an opposite angle closest to a straight line connecting between a center of gravity of the shape defined by the second antenna conductor and the vertex having the second power feeding angle among opposite angles of the second power feeding angle, is called a second diagonal;

the first antenna conductor and the second antenna conductor are disposed so that the first diagonal and the second diagonal are in alignment or substantial alignment with each other.

16. The planar antenna according to claim 15, wherein the first capacitive coupling conductors are parallel or substantially parallel with at least one of sides, which are not consecutive to the first power feeding angle; and wherein the second capacitive coupling conductors are parallel with or substantially parallel with at least one of sides, which are not consecutive to the second power feeding angle.

17. The planar antenna according to claim 8, wherein the first feeding point is disposed on an opposite side of the first junction portions with respect to the first straight line; and wherein the second feeding point is disposed on an opposite side of the second junction portions with respect to the second straight line.

18. The planar antenna according to claim 8, wherein the first feeding point is disposed on the same side as the first junction portions with respect to the first straight line; and wherein the second feeding point is disposed on the same side as the second junction portions with respect to the second straight line.

19. The planar antenna according to claim 7, wherein in a case wherein the shape defined by the first antenna conductor is a polygon or substantial polygon, and the shape defined by the second antenna conductor is a polygon or substantial polygon;

the first straight line is parallel or substantially parallel with at least one side among sides, which are not consecutive to the first power feeding angle; and the second straight line is parallel with or substantially parallel with at least one side among sides, which are not consecutive to the second power feeding angle.

20. The planar antenna according to claim 5, wherein in a case wherein a shape defined by the first antenna conductor is an ellipse or substantial ellipse, and a shape defined by the second antenna conductor is an ellipse or substantial ellipse; and the first antenna conductor and the second antenna conductor are disposed so that a straight line, which connects a long axis of the first antenna conductor, the first feeding point, a long axis of the second feeding point, and the second feeding point, is in alignment or substantial alignment.

21. The planar antenna according to claim 1, wherein the dielectric substrate is a window glass sheet for vehicles.

22. The planar antenna according to claim 5, wherein the dielectric substrate is a window glass sheet for vehicles; and wherein when the imaginary line connecting between the center of gravity of the first antenna conductor and the center of gravity of the second antenna conductor is called the transverse line, and when the window glass sheet is viewed from an interior side or an exterior side, the coupling branch lines of the first capacitive coupling conductors are in alignment or substantial alignment with each other; and the coupling branch lines of the second capacitive coupling conductors are in alignment or substantial alignment with each other;

an angle included between a first capacitive conductor and the transverse line is from 30 to 60 deg in a case wherein the transverse line is clockwise viewed from the first capacitive conductor in the viewing direction; and an angle included between a second capacitive conductor and the transverse line is from 30 to 60 deg in a case wherein the transverse line is clockwise viewed from the second capacitive conductor in the viewing direction.

23. The planar antenna according to claim 15, wherein when each of the shape defined by the first antenna conductor and the shape defined by the second antenna conductor is a square or substantial square, when each of the shape has a side of Lx, when a shortest distance between a first feeding point and the first capacitive coupling conductors, and when a shortest distance between a second feeding point and the second capacitive coupling conductors are La, the following formula is satisfied:

$$0.66 \leqq L_a/L_x \leqq 0.86.$$

24. The planar antenna according to claim 1, wherein the dielectric substrate is a window glass sheet for vehicles;

wherein when a radio wave for communication has a wavelength of $\lambda_0$ in air, when a shortest distance between the first antenna conductor and a vehicle opening edge is $L_1$, and when a shortest distance between the second antenna conductor and the vehicle opening edge is $L_2$, the following formulae are satisfied:

$$0.10 \leqq L_1/\lambda_0 \text{ and } 0.10 \leqq L_2/\lambda_0$$

and;

wherein a shortest distance between a portion of the planar antenna farthest from the vehicle opening edge and the vehicle opening edge is not longer than 200 mm.

25. The planar antenna according to claim 1, wherein the dielectric substrate is a window glass sheet for a vehicle;

wherein when an imaginary line connecting between a center of gravity of the first antenna conductor and a center of gravity of the second antenna conductor is called a transverse line, an angle included between a vehicle opening edge closest to the planar antenna and the transverse line is from 45 to 135 deg;

wherein when a radio wave for communication has a wavelength of $\lambda_0$ in air, and when a shortest distance between a conductor formed on a window glass sheet of the planar antenna and the vehicle opening edge is $L_3$, the following formula is satisfied:

$$0.04 \leqq L_3/\lambda_0$$

and wherein a shortest distance between a portion of the planar antenna farthest from the vehicle opening edge and the vehicle opening edge is not longer than 200 mm.

26. The planar antenna according to claim 1, wherein the first antenna conductor has a first feeding point formed at a position closest to or in the vicinity of the second antenna conductor; and wherein the second antenna conductor has a second feeding point formed at a position closest to or in the vicinity of the first antenna conductor.

27. The planar antenna according to claim 1, wherein when the planar antenna is employed as a receiving antenna, power is fed from the first antenna conductor and the second antenna conductor; and wherein when the planar antenna is employed as a transmitting antenna, power is fed to the first antenna conductor and the second antenna conductor.

28. The planar antenna according to claim 1, wherein the dielectric substrate has a passive element disposed on at least one of a surface around the first antenna conductor and the second antenna conductor, the surface having the first antenna conductor and the second antenna conductor disposed thereon.

29. The planar antenna according to claim 1, wherein the dielectric substrate is a window glass sheet for a vehicle;

wherein the first antenna conductor and the second antenna conductor are disposed on an interior-side surface of the window glass sheet; and wherein the window glass sheet has a radio wave reflecting means disposed on the interior side and at a position in the vicinity of the first antenna conductor and the second antenna conductor.

30. A planar antenna for a circularly polarized wave, comprising:

a dielectric substrate having a first antenna conductor in a loop shape and a second antenna conductor in a loop shape disposed so as to be adjacent to each other;

wherein there is disposed a first coupling conductor, the first coupling conductor comprising a pair of coupling branch lines connected to the first antenna conductor and extending inward from the first antenna conductor, and the coupling branch lines being adjacent to each other so as to be capacitively coupled to each other; and wherein there is disposed a second coupling conductor, the second coupling conductor comprising a pair of coupling branch lines connected to the second antenna conductor and extending inward from the second antenna conductor, and the coupling branch lines being adjacent to each other so as to be capacitively coupled to each other;

wherein the first antenna conductor has a first feeding point formed at a position closest to or in the vicinity of the second antenna conductor; and wherein the second antenna conductor has a second feeding point formed at a position closest to or in the vicinity of the first antenna conductor.

31. A planar antenna comprising a dielectric substrate having a first antenna conductor in a loop shape and a second antenna conductor in a loop shape disposed so as to be adjacent to each other;

wherein the first antenna conductor has a first branch line connected thereto and extending inward therefrom, and no branch line close to the first branch line is disposed inside the first antenna conductor (3);

wherein the second antenna conductor has a second branch line connected thereto and extending inward therefrom, and no branch line close to the second branch line is disposed inside the second antenna conductor;

wherein each of the first branch line and the second branch line has an open end;

wherein when a length of the first branch line is called $L_{b1}$, and a length of the second branch line is called $L_{b2}$;

when an entire length of the first antenna conductor in a loop shape is called $L_{L1}$, and when an entire length of the second antenna conductor in a loop shape is called $L_{L2}$, formulae of $0.130 \leqq L_{b1}/L_{L1}$ and $0.130 \leqq L_{b2}/L_{L2}$ are satisfied; and wherein a shortest distance between the first antenna conductor and the open end of the first branch line is not shorter than 0.1 mm, and a shortest distance between the second antenna conductor and the open end of the second branch line is not shorter than 0.1 mm.

32. The planar antenna according to claim 31, wherein when an imaginary line connecting between a center of gravity of the first antenna conductor and a center of gravity of the second antenna conductor is called a transverse line, the first branch line and the second branch line are symmetrical or substantially symmetrical with each other about a central point of the transverse line.

33. A planar antenna for a circularly polarized wave, comprising a dielectric substrate having a first antenna conductor in a loop shape and a second antenna conductor in a loop shape disposed so as to be adjacent to each other;

wherein there is a first auxiliary line, which connects a first point of the first antenna conductor and a second point of the first antenna conductor except for the first point; and that there is a second auxiliary line, which connects a first point of the second antenna conductor and a second point of the second antenna conductor except for the first point; and that when an imaginary line connecting between a center of gravity of the first antenna conductor and a center of gravity of the second antenna conductor is called a transverse line, the first auxiliary line and the second auxiliary line are symmetrical or substantially symmetrical with each other about a central point of the transverse line.

34. The planar antenna according to claim 33, wherein the first antenna conductor has a first feeding point formed thereon, and the second antenna conductor has a second feeding point formed thereon;

wherein a conductive film is disposed in at least one portion of a region, which is surrounded by the first antenna conductor and the first auxiliary line, and which has no contact with the first feeding point; and wherein a conductive film is disposed in at least one of a region, which is surrounded by the second antenna conductor and the second auxiliary line, and which has no contact with the second feeding point.

35. The planar antenna according to claim 33, wherein the first antenna conductor has a first feeding point formed thereon, and the second antenna conductor has a second feeding point formed thereon;

wherein a conductive film is disposed in at least one of a region, which is surrounded by the first antenna conductor and the first auxiliary line, and which has contact with the first feeding point; and wherein a conductive film is disposed in at least one of a region, which is surrounded by the second antenna conductor and the second auxiliary line, and which has contact with the second feeding point.

36. The planar antenna according to claim 33, wherein when the imaginary line connecting between the center of gravity of the first antenna conductor and the center of gravity of the second antenna conductor is called the transverse line, an angle included between the first auxiliary line and the transverse line is from 116 to 152 deg in a case wherein the transverse line is clockwise viewed from the first auxiliary line in a viewing direction, which is a direction for a radio wave to come or a radio wave to be radiated from the planar antenna, and wherein an electric field generated by a circularly polarized wave of the radio wave is counterclockwise rotated in the viewing direction; and an angle included between the second auxiliary line and the transverse line is from 116 to 152 deg in a case wherein the transverse line is clockwise viewed from the second auxiliary line in the viewing direction.

37. The planar antenna according to claim 33, wherein the first auxiliary line and the second auxiliary line are linear or substantially linear; and wherein when the imaginary line connecting between the center of gravity of the first antenna conductor and the center of gravity of the second antenna conductor is called the transverse line, an angle included between the first auxiliary line and the transverse line is from 28 to 64 deg in a case wherein the transverse line is clockwise viewed from the first auxiliary line in a viewing direction, which is a direction for a radio wave to come or a radio wave to be radiated from the planar antenna, and wherein an electric field generated by a circularly polarized wave of the radio wave is clockwise rotated in the viewing direction; and an angle included between the second auxiliary line and the transverse line is from 28 to 64 deg in a case wherein the transverse line is clockwise viewed from each of the second auxiliary line in the viewing direction.

38. A planar antenna comprising a first antenna conductor and a second antenna conductor, the first antenna conductor including a capacitive coupling portion formed by cutting out a portion of a loop conductor by a length, and the second antenna conductor including a capacitive coupling portion formed by cutting out a portion of a loop conductor by a length;

wherein the first antenna conductor and the second antenna conductor are disposed on a window glass sheet for a vehicle so as to be adjacent to each other;

wherein when a radio wave for communication has a wavelength of $\lambda_0$ in air, when a shortest distance between the first antenna conductor and a vehicle opening edge is $L_1$, and when a shortest distance between the second antenna conductor and the vehicle opening edge is $L_2$, the following formulae are satisfied:

$$0.10 \leq L_1/\lambda_0 \text{ and } 0.10 \leq L_2/\lambda_0$$

and;

wherein a shortest distance between a portion of the planar antenna farthest from the vehicle opening edge and the vehicle opening edge is not longer than 200 mm.

39. The planar antenna according to claim 38, wherein when an imaginary line connecting between a center of gravity of the first antenna conductor and a center of gravity of the second antenna conductor is called a transverse line, when the capacitive coupling portion of the first antenna conductor is called a first capacitive coupling portion, and when the capacitive coupling portion of the second antenna conductor is called a second capacitive coupling portion, the first capacitive coupling portion and the second capacitive coupling portion are disposed on opposite sides with respect to the transverse line and an extending line thereof.

40. A planar antenna comprising a first antenna conductor and a second antenna conductor, the first antenna conductor including a capacitive coupling portion formed by cutting out a portion of a loop conductor by a length, and the second antenna conductor including a capacitive coupling portion formed by cutting out a portion of a loop conductor by a length;

wherein the first antenna conductor and the second antenna conductor are disposed on a window glass sheet for a vehicle so as to be adjacent to each other;

wherein when an imaginary line connecting between a center of gravity of the first antenna conductor and a center of gravity of the second antenna conductor is called a transverse line, an angle included between a vehicle opening edge closest to the planar antenna and the transverse line is from 45 to 135 deg;

wherein when a radio wave for communication has a wavelength of $\lambda_0$ in air, and when a shortest distance between the planar antenna and the vehicle opening edge is $L_3$, the following formula is satisfied:

$$0.04 \leqq L_3/\lambda_0$$

and wherein a shortest distance between a portion of the planar antenna farthest from the vehicle opening edge and the vehicle opening edge is not longer than 200 mm.

41. A planar antenna for a circularly polarized wave, comprising a dielectric substrate having a first antenna conductor in a loop shape and a second antenna conductor in a loop shape disposed so as to be adjacent to each other;

wherein the dielectric substrate is a window glass sheet for vehicles;

wherein when a radio wave for communication has a wavelength of $\lambda_0$ in air, when a shortest distance between the first antenna conductor and a vehicle opening edge is $L_1$, and when a shortest distance between the second antenna conductor and the vehicle opening edge is $L_2$, the following formulae are satisfied:

$$0.10 \leqq L_1/\lambda_0 \text{ and } 0.10 \leqq L_2/\lambda_0$$

and;

wherein a shortest distance between a portion of the planar antenna farthest from the vehicle opening edge and the vehicle opening edge is not longer than 200 mm.

42. A planar antenna for a circularly polarized wave, comprising a dielectric substrate having a first antenna conductor in a loop shape and a second antenna conductor in a loop shape disposed so as to be adjacent to each other;

wherein the dielectric substrate is a window glass sheet for a vehicle;

wherein when an imaginary line connecting between a center of gravity of the first antenna conductor and a center of gravity of the second antenna conductor is called a transverse line, an angle included between a vehicle opening edge closest to the planar antenna and the transverse line is from 45 to 135 deg;

wherein when a radio wave for communication has a wavelength of $\lambda_0$ in air, and when a shortest distance between the planar antenna and the vehicle opening edge is $L_3$, the following formulae are satisfied:

$$0.04 \leqq L_3/\lambda_0$$

and wherein a shortest distance between a portion of the planar antenna farthest from the vehicle opening edge and the vehicle opening edge is not longer than 200 mm.

43. A planar antenna comprising a dielectric substrate having a first antenna conductor in a loop shape and a second antenna conductor in a loop shape disposed so as to be adjacent to each other;

wherein there is disposed a first coupling conductor, the first coupling conductor comprising a pair of coupling branch lines connected to the first antenna conductor and extending inward from the first antenna conductor, and the coupling branch lines have open ends disposed so as to be adjacent to each other and to be capacitively coupled to each other;

wherein when the coupling branch lines are not parallel with each other, both open ends of the coupling branch lines or one of the open ends of the coupling branch lines is located in the vicinity of closest portions of the coupling branch lines;

wherein there is disposed a second coupling conductor, the second coupling conductor comprising a pair of coupling branch lines connected to the second antenna conductor and extending inward from the second antenna conductor, and the coupling branch lines have open ends disposed so as to be adjacent to each other and to be capacitively coupled to each other;

wherein when the coupling branch lines are parallel with each other or in alignment with each other, both open ends of the coupling branch lines are closest portions with respect to each other; and wherein when the coupling branch lines are not parallel with each other, both open ends of the coupling branch lines or one of the open ends of the coupling branch lines is located in the vicinity of closest portions of the coupling branch lines.

* * * * *